US008839824B2

(12) United States Patent
Cross et al.

(10) Patent No.: US 8,839,824 B2
(45) Date of Patent: Sep. 23, 2014

(54) MULTIPLE LAYER WEAVING

(71) Applicants: Tory M. Cross, Portland, OR (US); Bhupesh Dua, Portland, OR (US)

(72) Inventors: Tory M. Cross, Portland, OR (US); Bhupesh Dua, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/748,762

(22) Filed: Jan. 24, 2013

(65) Prior Publication Data

US 2013/0186506 A1 Jul. 25, 2013

Related U.S. Application Data

(60) Provisional application No. 61/590,183, filed on Jan. 24, 2012.

(51) Int. Cl.

| | |
|---|---|
| ***D03C 3/24*** | (2006.01) |
| ***D03D 41/00*** | (2006.01) |
| ***D03D 49/04*** | (2006.01) |
| ***D03J 1/00*** | (2006.01) |
| ***D06B 1/00*** | (2006.01) |
| ***D03C 3/20*** | (2006.01) |
| ***D03D 15/00*** | (2006.01) |
| ***D06C 7/00*** | (2006.01) |
| *D03C 11/00* | (2006.01) |

(52) U.S. Cl.

CPC *D03C 3/20* (2013.01); *D03D 41/00* (2013.01); *D03D 49/04* (2013.01); *D03J 1/00* (2013.01); *D06B 1/00* (2013.01); *D03D 15/0027* (2013.01); *D06C 7/00* (2013.01)

USPC ..... 139/54; 139/52; 139/50

(58) Field of Classification Search

CPC ..... D03D 41/00; D03D 15/00; D03D 49/10; D03D 49/20; D03D 13/00; D03C 13/00; D03C 1/14; D03C 9/0683

USPC ..... 139/54, 52, 50

See application file for complete search history.

(56) References Cited

U.S. PATENT DOCUMENTS

| | | | | |
|---|---|---|---|---|
| 2,294,368 | A * | 9/1942 | Harter | 139/192 |
| 3,143,149 | A * | 8/1964 | Stoudenmire | 139/48 |
| 3,610,292 | A | 10/1971 | Wasyleviez | |
| 3,621,885 | A | 11/1971 | Egloff et al. | |
| 3,626,991 | A | 12/1971 | Backenecker | |

(Continued)

FOREIGN PATENT DOCUMENTS

| | | |
|---|---|---|
| EP | 2175057 | 4/2010 |

OTHER PUBLICATIONS

Notification of Transmittal of the International Search Report and the Written Opinion of the International Searching Authority, or the Declaration in PCT/US13/22936, mailed Mar. 22, 2013, 29 pages.

(Continued)

*Primary Examiner* — Bobby Muromoto, Jr.
(74) *Attorney, Agent, or Firm* — Shook, Hardy & Bacon

(57) ABSTRACT

A weaving apparatus is provided herein for simultaneously weaving fine denier panels and coarse denier panels. The weaving apparatus includes a first warp beam that holds in tension a first number of small denier warp threads and a second warp beam that holds in tension a second number of large denier warp threads. The first number of small denier warp threads is greater than the second number of large denier warp threads.

9 Claims, 17 Drawing Sheets

(56) References Cited

U.S. PATENT DOCUMENTS

| | | | | | |
|---|---|---|---|---|---|
| 3,779,289 | A | | 12/1973 | Bulcock et al. | |
| 3,814,140 | A | | 6/1974 | Serturini | |
| 3,879,824 | A | | 4/1975 | Mizuno | |
| 3,916,956 | A | | 11/1975 | Harris et al. | |
| 4,031,925 | A | | 6/1977 | Santucci | |
| 4,046,172 | A | | 9/1977 | Russell | |
| 4,077,438 | A | | 3/1978 | Tanaka et al. | |
| 4,448,223 | A | | 5/1984 | Deborde et al. | |
| 4,520,849 | A | | 6/1985 | Suzuki et al. | |
| 4,526,211 | A | | 7/1985 | Suso | |
| 4,546,802 | A | | 10/1985 | Best | |
| 4,600,039 | A | | 7/1986 | Corain | |
| 4,688,606 | A | | 8/1987 | Tamatani | |
| 4,756,343 | A | | 7/1988 | Angebault et al. | |
| 4,781,221 | A | | 11/1988 | Onishi et al. | |
| 4,815,498 | A | | 3/1989 | Gryson et al. | |
| 4,834,145 | A | | 5/1989 | Lewyllie et al. | |
| 4,834,147 | A | | 5/1989 | Eberle et al. | |
| 4,909,283 | A | | 3/1990 | Verclyte | |
| 4,917,153 | A | | 4/1990 | Mori et al. | |
| 4,957,144 | A | | 9/1990 | Watanabe et al. | |
| 4,964,442 | A | | 10/1990 | Tacq et al. | |
| 5,050,647 | A | | 9/1991 | Baeck et al. | |
| 5,070,912 | A | | 12/1991 | Ludwig | |
| 5,075,151 | A | * | 12/1991 | Kufner et al. | 428/198 |
| 5,090,456 | A | | 2/1992 | Kasahara | |
| 5,105,855 | A | | 4/1992 | Stacher | |
| 5,105,856 | A | | 4/1992 | Wahhoud | |
| 5,158,119 | A | | 10/1992 | Pezzoli et al. | |
| 5,332,007 | A | | 7/1994 | Wahhoud | |
| 5,335,699 | A | * | 8/1994 | Beyaert et al. | 139/82 |
| 5,375,627 | A | * | 12/1994 | Iida et al. | 139/11 |
| 5,568,827 | A | | 10/1996 | Debaes et al. | |
| 5,575,314 | A | | 11/1996 | Capitanio et al. | |
| 5,588,470 | A | * | 12/1996 | Shiraki et al. | 139/435.5 |
| 5,649,570 | A | | 7/1997 | Wahhoud et al. | |
| 5,669,424 | A | | 9/1997 | Schiller et al. | |
| 5,735,316 | A | | 4/1998 | Hehle | |
| 6,026,865 | A | | 2/2000 | Krumm et al. | |
| 6,039,086 | A | | 3/2000 | Dornier et al. | |
| 6,050,302 | A | * | 4/2000 | Guse et al. | 139/1 R |
| 6,058,980 | A | | 5/2000 | Scari et al. | |
| 6,223,779 | B1 | | 5/2001 | Speich | |
| 6,260,586 | B1 | | 7/2001 | Fratus | |
| 6,311,737 | B2 | * | 11/2001 | Wahhoud et al. | 139/50 |
| 6,321,796 | B1 | | 11/2001 | Sawada | |
| 6,470,917 | B1 | | 10/2002 | Yamamoto | |
| 6,575,201 | B2 | | 6/2003 | Buesgen | |
| 2001/0013377 | A1 | * | 8/2001 | Wahhoud et al. | 139/54 |
| 2002/0009590 | A1 | * | 1/2002 | Matsui et al. | 428/374 |
| 2002/0020457 | A1 | | 2/2002 | Yamamoto | |
| 2003/0051295 | A1 | | 3/2003 | Soane et al. | |
| 2003/0187140 | A1 | * | 10/2003 | Lintecum et al. | 525/178 |
| 2004/0020548 | A1 | * | 2/2004 | Yamamoto | 139/2 |
| 2004/0021255 | A1 | | 2/2004 | Bilanin et al. | |
| 2004/0154679 | A1 | | 8/2004 | Yamamoto | |
| 2005/0166989 | A1 | | 8/2005 | Debaes et al. | |
| 2006/0144458 | A1 | | 7/2006 | Wahhound et al. | |
| 2007/0087162 | A1 | * | 4/2007 | Mandawewala | 428/97 |
| 2008/0085648 | A1 | * | 4/2008 | Hirosue et al. | 442/183 |
| 2009/0007981 | A1 | * | 1/2009 | Khokar | 139/383 A |
| 2009/0056900 | A1 | * | 3/2009 | O'Connor et al. | 162/358.2 |
| 2010/0077634 | A1 | * | 4/2010 | Bell | 36/54 |
| 2011/0132488 | A1 | * | 6/2011 | Teng et al. | 139/35 |

OTHER PUBLICATIONS

Notification of Transmittal of the International Search Report and the Written Opinion of the International Searching Authority, or the Declaration in PCT/US13/22946, mailed Mar. 29, 2013, 22 pages.

Naskar et al. "Studies on Tyre Chords: Degradation of Polyester Due to Fatigue" Polymer Degradation and Stability. vol. 83, Issue 1, pp. 1730180. Especially Table 2, p. 178 (Jan. 2004).

Notice of Allowance and Fee(s) Due in U.S. Appl. No. 13/748,758 mailed Apr. 8, 2014.

* cited by examiner

MULTIPLE LAYER WEAVING

CROSS-REFERENCE TO RELATED APPLICATIONS

This application claims the benefit of priority of U.S. Provisional Application No. 61/590,183, filed Jan. 24, 2012 and entitled "Multi-Functional Weaving System." The entirety of the aforementioned application is incorporated by reference herein.

TECHNICAL FIELD

The present invention relates to a multi-functional weaving system for weaving textiles, apparel, accessories, and shoes. More specifically, the present invention relates to using different types of weaving materials, weaving processes, and weaving patterns to impart different properties to a woven product. As well, the present invention relates to an intermittent weaving splicer that dynamically terminates and combines different materials, which are subsequently used to weave different types of apparel, accessories, and shoes. The present invention also relates to a dynamic tensioner that applies varying levels of tension to weaving materials based on properties of the material. Additionally, the present invention relates to one or more finishing devices used to finish lateral portions and interior portions of a product as it is being woven.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects of the present invention are directed toward a woven product comprising at least one panel with a greater number of warp threads that is woven to a second panel with a lesser number of warp threads. The panel with the greater number of warp threads may be a graphics panel or a comfort panel, while the panel with the lesser number of warp threads may be a stability or durability panel.

The aspects of the present invention are also directed to the use of reactive weaving materials that may be selectively activated to achieve certain properties in portions of the woven product. The present invention is also directed to an apparatus that increases the tension on warps threads in select places along a warp beam immediately prior to introducing the weft to produce selected deformities to the woven product.

Additionally, aspects of the present invention are directed toward an intermittent splicer that dynamically terminates a material (e.g., yarn, thread, fiber) and combines different materials to create a combined material having different functional or aesthetic properties along the length of the combined material. The combined material may subsequently be used in the weaving of a variety of structures including fabrics, textiles, composite base materials, apparel, shoes, and accessories. For example, aspects of the following may be implemented in the manufacture of two-dimensional and/or three-dimensional articles. The varying properties of the combined material may, in turn, impart different properties to the woven product at one or more locations.

The present invention is also directed to a dynamic tensioner that applies variable amounts of tension to the combined material while it is being woven. The amount of tension applied depends on the characteristics or properties of the combined material and/or a desired resulting product. The dynamic tensioner may be used in combination with the intermittent splicer to assist in the accurate placement of the combined material in the woven product.

As well, aspects of the present invention are directed to one or more finishing devices that can dynamically finish one side of a woven product independently of a second side of the woven product. For example, a right side and a left side of a woven article may be finished independently of one another. The sides may be finished in a non-linear fashion, such as an organic geometry, which eliminates the need for at least some post-processing pattern cutting. Additionally, one or more finishing devices of the present invention can be dynamically (e.g., moveably) positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

It is contemplated that one or more of the aspects of the present invention may be used in combination to achieve a desired woven article having desired properties.

Accordingly, the present invention is directed to a weaving apparatus comprising a first beam having a first number of warps and a second beam having a second number of warps, where the first number of warps is greater than the second number of warps.

In a second aspect, the present invention is directed to a weaving apparatus for multiple panel weaving. The weaving apparatus comprises a first beam having a first number of warp threads and a second beam having a second number of warp threads where the first number of warp threads is greater than the second number of warp threads. Further, each warp thread of the first number of warp threads has a smaller denier than each warp thread of the second number of warp threads. The weaving apparatus further comprises a beater adapted to at least the first number of warp threads and the second number of warp threads, a logic unit, and a weft loader functional to load a first weft material in connection with the first number of warp threads and a second weft material in connection with the second number of warp threads.

BRIEF DESCRIPTION OF THE DRAWINGS

Examples are described in detail below with reference to the attached drawing figures, wherein.

DETAILED DESCRIPTION

Figure 1:
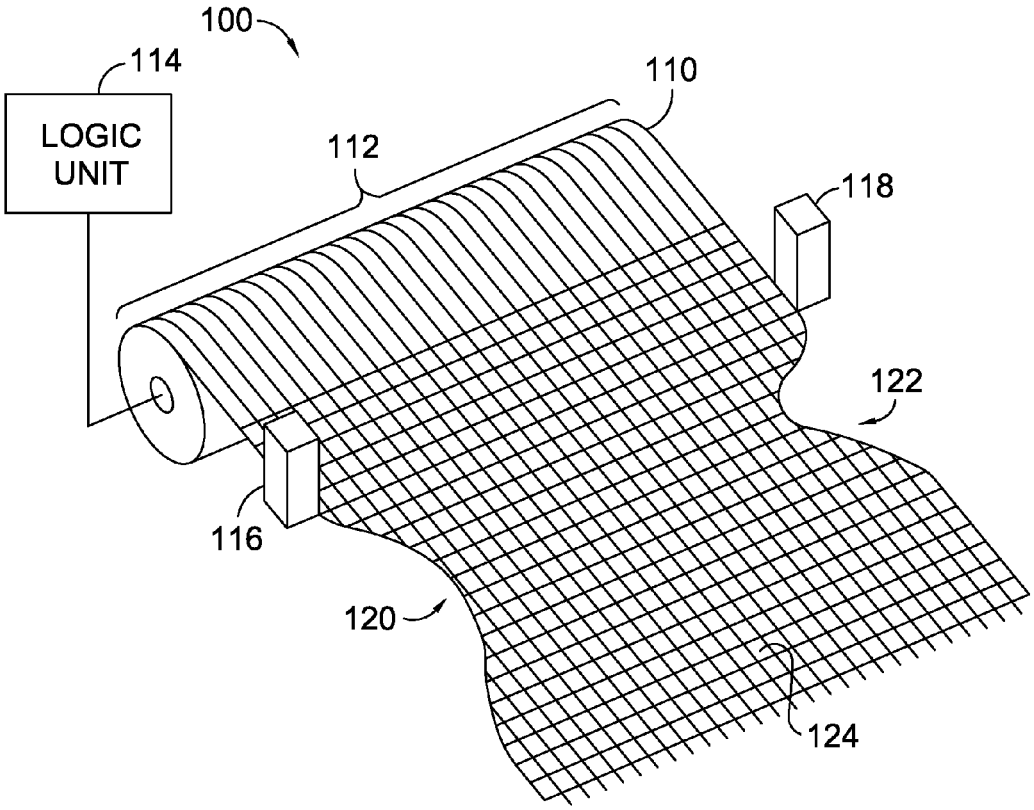
FIG. 1 depicts a top view of a loom with lateral finishing devices in an aspect of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed toward a woven product comprising at least one panel with a greater number of warp threads that is woven to a second panel with a lesser number of warp threads. The panel with the greater number of warp threads may be a graphics panel or a comfort panel, while the panel with the lesser number of warp threads may be a stability or durability panel.

The present invention also includes aspects directed to the use of reactive weaving materials that may be selectively activated to achieve certain properties in portions of the woven product. The present invention is also directed to an apparatus that increases the tension on warps threads in select places along a warp beam immediately prior to introducing the weft to produce selected deformities to the woven product.

Additionally, aspects of the present invention are directed toward an intermittent splicer that dynamically terminates a material (e.g., yarn, thread, fiber) and combines different materials to create a combined material having different functional or aesthetic properties along the length of the combined material. The combined material may subsequently be used in the weaving of a variety of structures including fabrics, textiles, composite base materials, apparel, shoes, and accessories. For example, aspects of the following may be implemented in the manufacture of two-dimensional and/or three-dimensional articles. The varying properties of the combined material may, in turn, impart different properties to the woven product at one or more locations.

The present invention is also directed to a dynamic tensioner that applies variable amounts of tension to the combined material while it is being woven. The amount of tension applied depends on the characteristics or properties of the combined material and/or a desired resulting product. The dynamic tensioner may be used in combination with the intermittent splicer to assist in the accurate placement of the combined material in the woven product.

As well, aspects of the present invention are directed to one or more finishing devices that can dynamically finish one side of a woven product independently of a second side of the woven product. For example, a right side and a left side of a woven article may be finished independently of one another. The sides may be finished in a non-linear fashion, such as an organic geometry, which eliminates the need for at least some post-processing pattern cutting. Additionally, one or more finishing devices of the present invention can be dynamically (e.g., moveably) positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

It is contemplated that one or more of the aspects of the present invention may be used in combination to achieve a desired woven article having desired properties.

Articles with Variable Number Warp Threads, Reactive Weaving Materials, and Weaving Methods FIGS. 1-11 are discussed hereinafter with respect to the Finishing Device portion.

Figure 12:
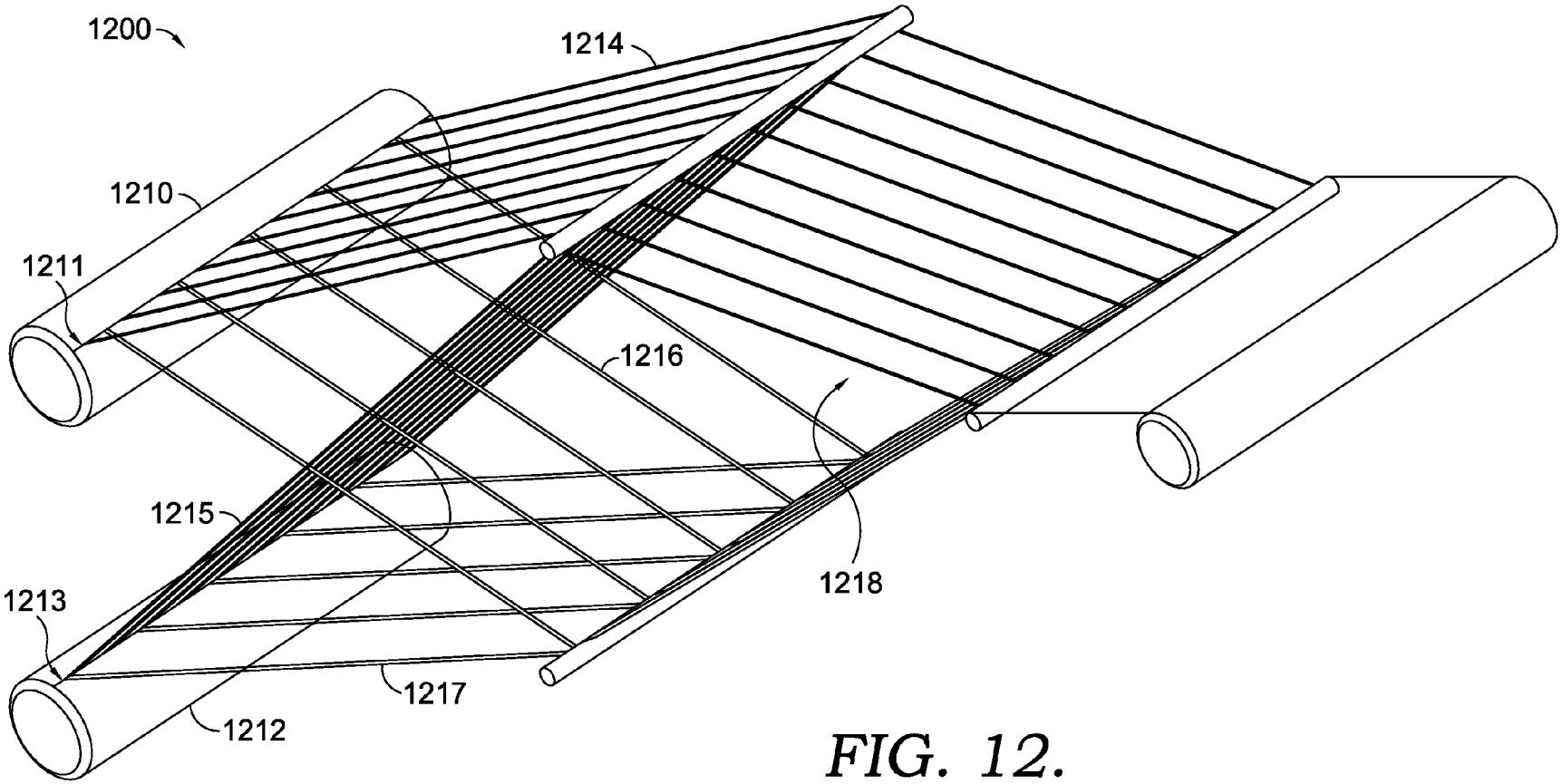
FIG. 12 depicts a loom with multiple panel weaving capabilities having a first warp with a greater number of warp threads as compared to a second warp with a lesser number of warp threads in an aspect of the present invention.

Turning now to FIG. 12, a side perspective view of a loom 1200 having two beams is depicted. The loom 1200 may comprise any type of weaving structure. For example, the loom 1200 may comprise a Jacquard loom, a Dobby loom, and other looms known in the art. Further, although only two beams are depicted, it is contemplated that the loom 1200 may have multiple beams each holding one or more sets of warp threads. Although the term "thread" is used for convenience sake, it is contemplated that the term "thread" may comprise any type of material (e.g., thread, yarn, webbing, braid, filaments, fibers), which may be formed from any type of substance including fabric materials, plastic materials, synthetic materials, metal materials, extruded materials, organic materials, engineered materials, and the like.

The loom 1200 comprises a first beam 1210 having a first set of warp threads 1214 in an "up" position and a second set of warp threads 1216 in a "down" position. A second beam 1212 may have a first set of warp threads 1215 in an "up" position and a second set of warp threads 1217 in a down position. In this example, the first beam 1210 may be comprised of a higher denier thread than the second beam 1212. As a result, if the first beam 1210 and the second beam 1212 have a similar beam length (e.g., 60 inches), the second beam 1212 may have a greater end count (i.e., a number of warp threads along the beam length). Stated differently, because the threads on the first beam 1210 are larger, the number of warp threads that may fit along the beam length of the first beam 1210 is less than the second beam 1212.

The incorporation of multiple layers having different warp deniers allows for an integrally woven article that can exhibit different characteristics at different surfaces. For example, as previously indicated, the layer or surface resulting from the coarser (e.g., larger denier) warp thread may have greater abrasion resistance and tensile strength characteristics, which may be better suited for an exterior surface of an article. Complementary, a layer or surface comprised of finer threads (i.e., smaller denier) may allow for a better skin contacting surface and therefore be suited for an interior article surface. Further yet, the finer threads may also be more conducive for forming woven graphical surfaces because a higher resolution may be achieved with the finer threads. As a result, the finer thread layer may be conducive for a location at which graphics are intended to be incorporated. These characteristics may result in a number of layer combinations that provide different characteristics (e.g., finer thread interior surface, a coarser thread internal layer for structure, and a finer thread exterior for graphical integration).

The fine warp threads 1215 and 1217 may have different functional and/or aesthetic properties from the coarse warp threads 1214 and 1216. For instance, the fine warp threads 1215 and 1217 may comprise materials of small diameter and a fine consistency suitable for weaving graphics or for providing a soft layer next to a user's skin. In contrast, the coarse warp threads 1214 and 1216 may comprise materials of a larger diameter and a coarser consistency designed for durability, stretch, stability, water resistance, heat resistance, and the like.

The fine warp threads 1215 and 1217 may be greater in number than the coarse warp threads 1214 and 1216. By way of illustrative example, the fine warp threads 1215 and 1217 may comprise 4000 warp threads, and the coarse warp threads 1214 and 1216 may comprise 400 warp threads.

In an exemplary aspect, a Jacquard loom is utilized to allow for the selective integration of one or more tie yarns between a first layer and a second layer. For example, it is contemplated that a first weft thread having a greater denier is interwoven with the warp threads from the first beam 1210 as compared to a second weft thread that is interwoven with the warp threads of the second beam 1212. Adjusting the weft threads to coordinate with (or otherwise deviate from) the warp threads of a particular beam may allow for the incorporation of particular functionality. As way of an illustrative example, when a fine warp thread is used to achieve a high resolution for graphical purposes, it is contemplated that a fine weft thread (of varied finishes) may then also be used to maintain a higher graphical resolution. Similarly, it is contemplated that if a greater denier warp thread is used to impart structural characteristics that a similarly robust weft thread may be interwoven to further ensure those structural characteristics are achieved.

The use of a Jacquard-type loom may allow for a substantial portion of each layer (e.g., coarse warp layer and a fine warp layer) to be woven apart from one another. However, to provide a binding effect between the layers to maintain an aligned relationship, it is contemplated that one or more warp threads from one or more layers may be interwoven with weft threads that are primarily interwoven with warp threads from an alternative layer. For example, when weaving a first layer that is comprised primarily of warp threads from a first warp beam, the Jacquard loom may be instructed to lift (or drop) one or more warps from a second warp beam into the shed through which the weft thread is being inserted. This essentially binds the first layer and the second layer using tie-like yarns that extend between the two layers. It is contemplated that the tie yarns may be positioned along a perimeter of the woven article (allowing for a pocket-like volume to be formed between the layers). It is also contemplated that the tie-like connections may be inserted at substantially random locations providing a uniform bond between layers. Further, it is contemplated that the tie-like structures may be inserted at defined locations to provide a three-dimensional control over a resulting woven article that may have a substance (e.g., fill, down, air) inserted between the layers. Other locations of the tie-like structures are contemplated anywhere along the perimeter of the warp beam, the woven article, and anywhere in an interior location.

Figure 13:
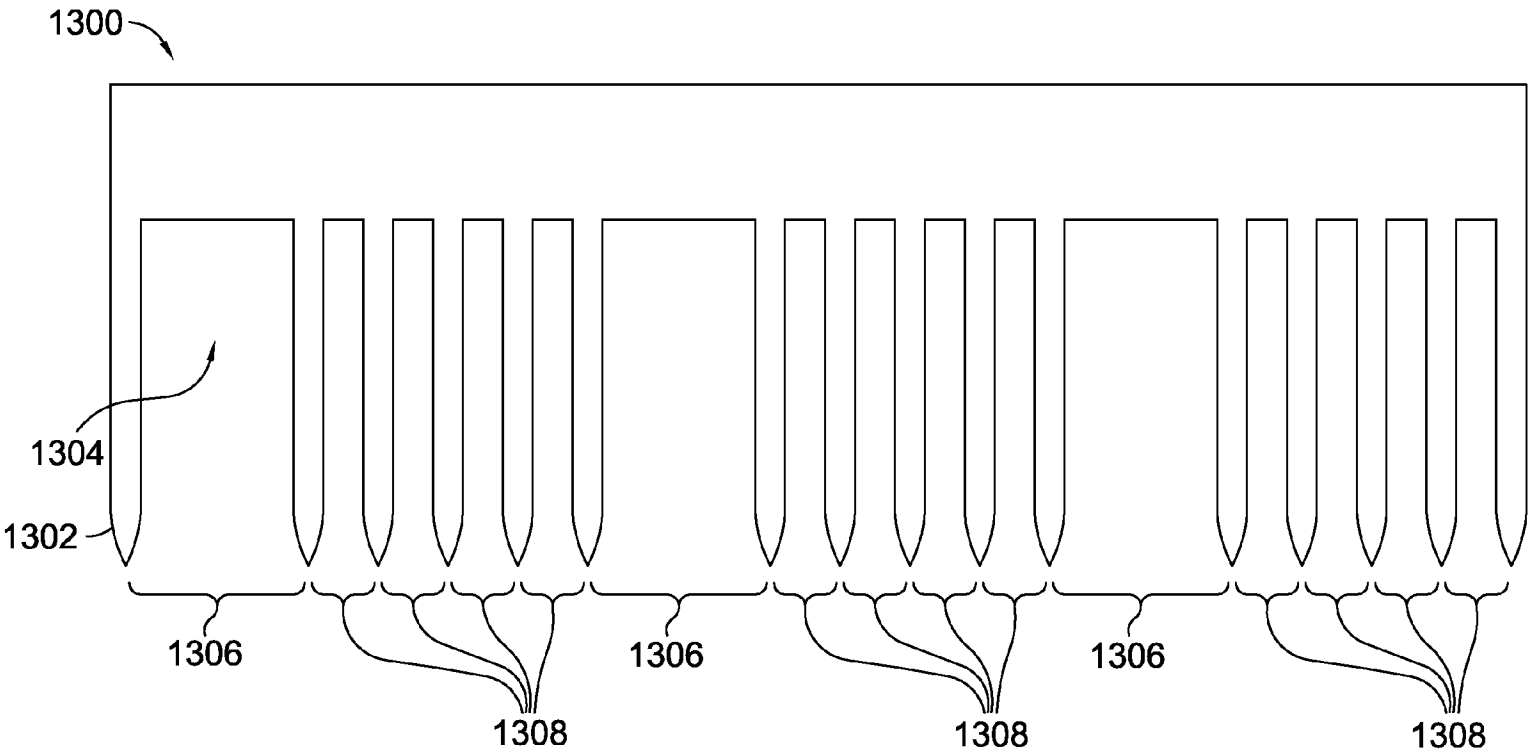
FIG. 13 depicts an exemplary loom beater used in conjunction with a multi-layered woven articles in an aspect of the present invention.

Turning to FIG. 13 illustrating an exemplary loom beater 1300 used in connection with a multi-layered woven article, in accordance with aspects of the present invention. The loom beater 1300 is comprised of a plurality of reeds 1302 extending the length of the loom beater 1300. A slot that is formed between each of the reeds is referred to herein as a dent 1304. Typically a warp thread will extend through the dent 1304 so that the reeds 1302 may pack the wefts in the woven article. In this illustrated example, the size of the dents 1304 is not consistent across the length of the beater 1300.

A typical beater has a uniform dent that is selected based on the warp thread characteristics. However, in aspects contemplated herein, two or more warp threads may be packed simultaneously as a result of the multi-beam implementation having different warp threads. In the illustrated example, there are four smaller dents 1308 between each larger dent 1306, which results in a 4:1 ratio of smaller denier warp threads to larger denier warp threads being packed simultaneously. This ratio may be adjusted based on the thread count of the various warp beams being simultaneously packed by the beater. In this example the finer warp thread may have a four times the thread count as the coarser warp thread. Any ratio and any ordering of dents (size of slot) are contemplated to effectively pack a weft when two or more warp materials are utilized. Other exemplary arrangements of beaters are contemplated.

Figure 14:
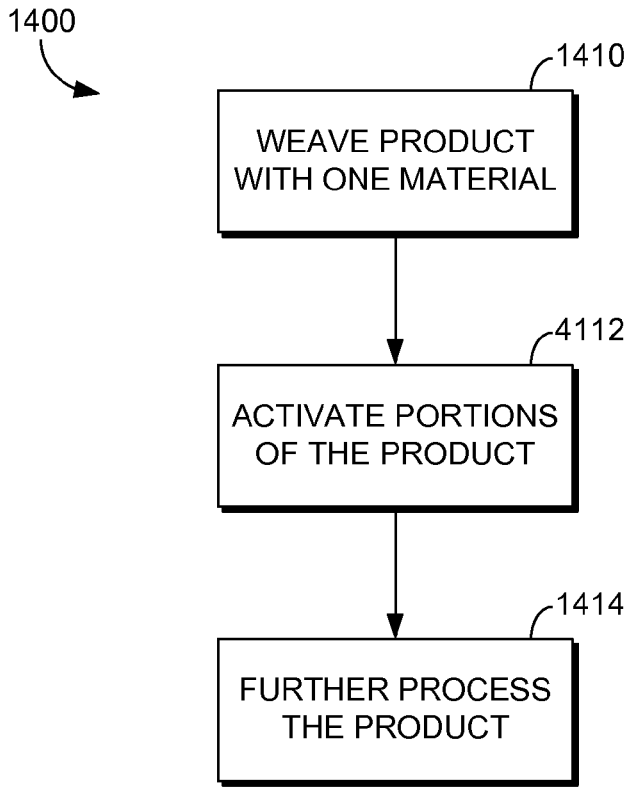
FIG. 14 depicts an exemplary flow diagram of a method of weaving using reactive materials in an aspect of the present invention.

The aspects of the present invention are also directed toward weaving using reactive materials. FIG. 14 depicts a block diagram illustrating an exemplary method 1400 for weaving using reactive materials, in accordance with aspects of the present invention. The term "reactive material" is meant to encompass a wide variety of materials. For instance, the weaving materials may be water soluble, etchable, thermoreactive, moldable, fusable, and the like. Further, the weaving materials may be coated with different types of materials to produce a core and an associated sheath. The core and/or the sheath may have different reactive and/or aesthetic properties. By way of illustrative example, the sheath may be water soluble, and the core may be water resistant. Alternatively, the sheath may be water resistant (while potentially being water permeable), and the core may be water soluble. In another illustrative example, the sheath may be one color and the core may be a second color. Products woven with these reactive materials may be processed to produce certain aesthetic properties and/or certain functional properties. The processing may occur while the product is being woven, or it may occur as a post-weaving processing step.

At a block 1410, a product is woven with one material. The material may have reactive characteristics as outlined above. Alternatively, the material may not have reactive characteristics. As will be discussed hereinafter, it is contemplated that an intermittent splicer may be utilized to insert a particular reactive material at a defined location within the woven article.

The weaving of a product with a material with reactive characteristics may include a material that prior to a reaction has a low stretch coefficient (e.g., a polymer-coated elastic material, where the polymer coating prevents the elastic properties of the core from being experienced). Following the reaction of the material, the underlying characteristics may be experienced. Therefore, traditional weaving techniques and equipment may be utilized that traditionally relies on a lower elasticity, but the resulting woven product may exhibit the elasticity property (at least in desired locations) by removing the restrictive sheath.

At a block 1412, selective portions of the woven product are treated or activated. In one aspect, activation or treatment may occur as the product is being woven. For instance, different activating devices such as a water jet, a heat device, a sintering laser, ultrasonic waves, chemicals, and the like may be applied to selective portions of the product while it is still on the loom. In another aspect, the activating mechanisms may be applied to selective portions of the product after weaving is complete and the product has been removed from the loom. In one example, selective portions of the product are treated with, for example, a mask. The mask may prevent the activation of the reactive material in defined locations that are desired to maintain the as-woven characteristics. Alternatively, the masked portion may determine the location at which the reactive material is activated.

Depending on the properties of the weaving material, activation of selective portions of the product may produce different functional or aesthetic properties. In one example, activation may cause selective portions of the product to dissolve or be eliminated thus producing apertures or open areas in the product. Activation may cause selective portions of the product to melt slightly and then reform to produce a solid portion in the product. As well, activation may cause selective portions of the product to change color. In another example, activation may cause selective portions of the product to be molded into certain shapes. Many other examples exist and are contemplated to be within the scope of the invention.

At a block 1414, further processing of the product may occur. For example, with respect to the treatment of selective portions of the product with a mask at block 1412, the mask may be reactive, and further processing may include activating the masked areas. Alternatively, the mask may be inert and be used to shield selective portions of the reactive materials from activation. In this case, the remainder of the product not covered by the mask may be activated using one or more of the activating devices discussed above.

Figure 15:
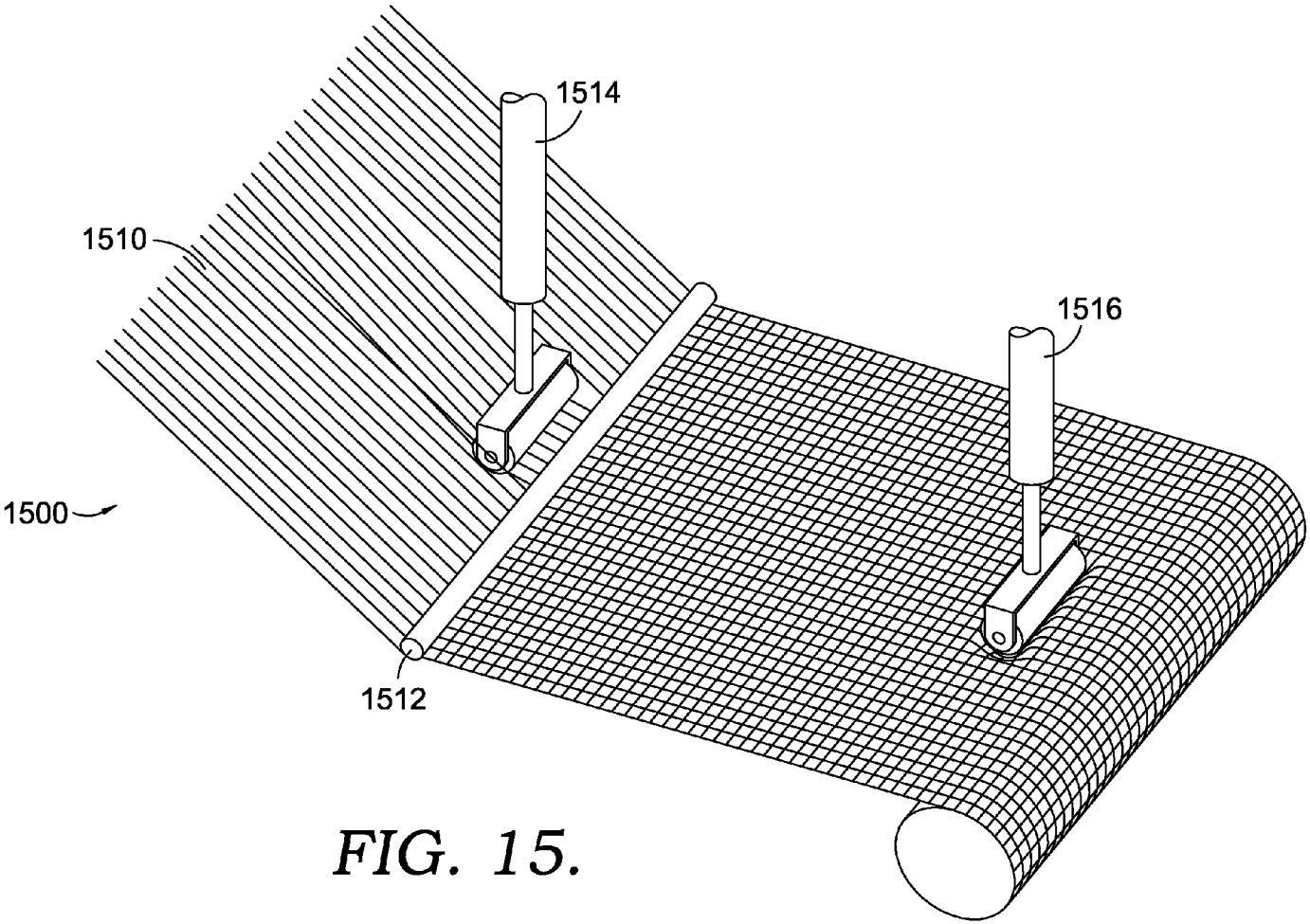
FIG. 15 depicts an apparatus for introducing three-dimensional effects to a panel as it is being woven in an aspect of the present invention.

FIG. 15 depicts an apparatus for introducing a three-dimensional (3-D) effect into a product as it is being woven. FIG. 15 includes a loom 1500, a set of warp threads, 1510, a weft insertion point 1512, a first 3-D effector 1514, and a second 3-D effector 1516. The loom 1500 may comprise any type of weaving structure. For example, the loom 1500 may comprise a single or multiple beam loom, a Jacquard loom, a Dobby loom, and other looms known in the art.

The first and second 3-D effectors 1514 and 1516 may be attached to one or more adjustable arms that act to move the 3-D effectors 1514 and 1516 laterally back and forth across the width of the panel and/or vertically to introduce changes in tension and excess in material. The first and second 3-D effectors 1514 and 1516 may also be attached to a support beam and moved by, for example, a screw drive or rollers. Further, the first and second 3-D effectors 1514 and 1516 may be pivoted out of the way when not needed. The contact head of the first and second 3-D effectors 1514 and 1516 may comprise any shape such as a cylinder, an ellipse, etc. The shape of the material contacting surface may determine the resulting 3-D form that results in the woven product. Although only two 3-D effectors are shown, it is contemplated that multiple effectors may be positioned across the width of the panel and at any location in the warp direction.

The first 3-D effector 1514 acts to increase the tension on the set of warp threads 1510 in select places along the width of the panel immediately prior to introducing the weft threads at the weft insertion point 1512. The weft threads are subsequently introduced at the weft insertion point 1512. The tension on the warp threads 1510 is maintained by the second 3-D effector 1516 as additional weft threads are inserted and the weft is packed. By maintaining increased tension on the set of warp threads 1510 during the insertion and packing of the weft threads, the deformity produced by the first and second 3-D effectors will be "locked" into place.

Further, it is contemplated that one or more 3-D effectors are positioned on the loom after the weft insertion point 1512, but prior to a loom beater that packs the weft. As such, the weft may be inserted in a substantially linear manner, as is typical, but before the weave is packed and "locked" into place, the 3-D effector increases the tension on one or more warps (and the inserted weft(s)). This increased tension may produce an excess in material at the location of the 3-D effector, which once the beater packs the weft, is maintained. This process may introduce deformations to an otherwise planar-type woven article. It is contemplated that the lateral position and the vertical position of one or more 3-D effectors may be dynamically altered during the weaving process, which may result in an organic three-dimensional form being introduced into the woven article.

While the 3-D effectors are depicted pressing in a common downward orientation, it is contemplated that a 3-D effector may exert a pressure in any direction at any location, and in any combination. Further, it is contemplated that any number and any position of a 3-D effector may be implemented.

Intermittent Weaving Splicer and Dynamic Tensioner

Figure 16:
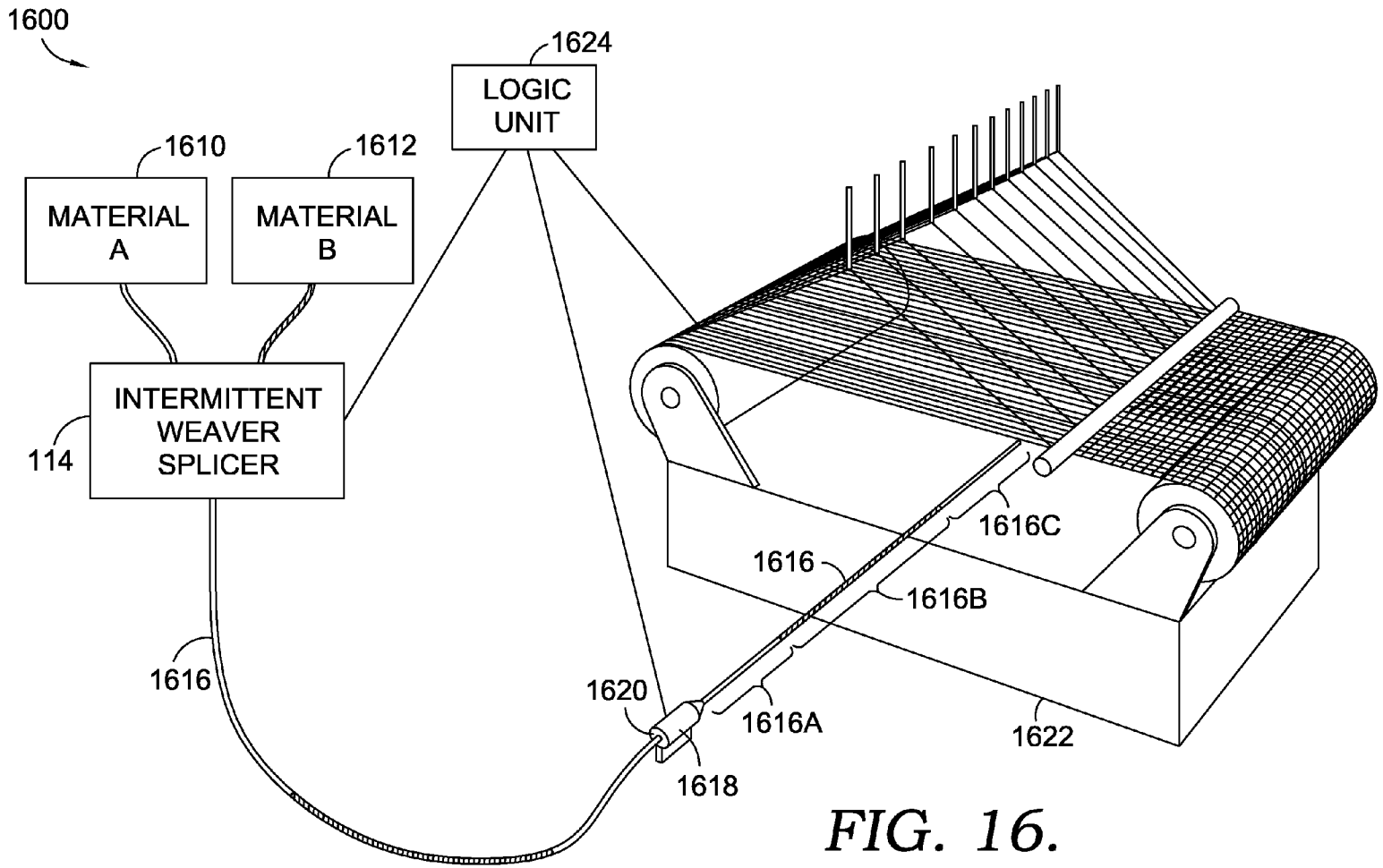
FIG. 16 depicts an exemplary intermittent weaving splicer within an exemplary weaving system in an aspect of the present invention.

FIG. 16 illustrates a system 1600 that comprises an intermittent weaving splicer 1614, a dynamic tensioner 1620, a feeding component 1618, a loom 1622, and a logic unit 1624. However, it is contemplated that additional components may be implemented in conjunction (or independently) with those depicted herein in exemplary aspects. Further, it is contemplated that any number of those components depicted, discussed, or implied in connection with FIG. 16 may also be implemented in exemplary aspects.

The intermittent splicer 1614 may receive two or more materials such as material A 1610 and material B 1612 through one or more input ports. As used herein, a material received by the intermittent splicer 1614 may include, for example, yarn, thread, webbing, strands, braids, and the like. Further, it is contemplated that the material may be formed, at least in part, with organic substances (e.g., cotton, rubber), polymer-based substances (e.g., nylon, polyester, synthetic rubber), metallic-based substances (e.g., copper, silver, gold, aluminum), and other engineered materials (e.g., aramid synthetic fibers, carbon-fiber, fiber glass). The material is also contemplated having varied physical characteristics (as will be discussed hereinafter). For example, the material may have varied diameter, elasticity, abrasion resistance, chemical reactivity traits, tension modulus, tensile strength, moisture absorbance, and the like.

The material A 1610 and the material B 1612 may comprise different types of materials. For instance, the materials 1610 and 1612 may differ in diameter, density, color, functional properties, aesthetic properties, mode of manufacture (extrusion, spun, molded, etc.), treatments applied to the materials 1610 and 1612, and so on. Functional properties may comprise elasticity, stiffness, water solubility, thermoreactivity, chemical reactivity, and the like. Treatments applied to the materials 1610 and 1612 may comprise water proofing, wax coating, and/or applying coatings that impart a matte, luster, reflective, or shiny finish to the materials 1610 and 1612. Treatments may also comprise reactive coatings that may react with water, heat, chemicals, and the like. Additionally, it is contemplated that a multi-substance material is used. A multi-substance material may be a material having an outer sheath of a different substance than an interior core. In this example, the outer sheath may impart certain characteristics to the multi-substance material that differ from the internal core. For example, the internal core may have a high elasticity and the outer core may be a reactive coating that prevents the stretch of the multi-substance material. Therefore, as will be discussed hereinafter, it is contemplated that portions of the outer core may be selectively removed (e.g., reactively removed by chemical means or light, for example) to allow the properties of the inner core to be exhibited in those portions where the outer core has been removed. Alternative arrangements of a multi-substance material are contemplated (e.g., reactive core, reactive fibers intertwined with non-reactive fibers).

Returning to FIG. 16, in an exemplary aspect, the intermittent splicer 1614 may receive material A 1610 through a first input port (not shown) and material B 112 through a second input port (not shown). Alternatively, material A 110 and material B 1612 may be received through a single input port. Although only two materials are depicted in FIG. 16, it is contemplated that the intermittent splicer 1614 may receive any number of materials. In an exemplary aspect, it is contemplated that the material is maintained by a spool-like structure for feeding into the intermittent splicer 1614 for effective receipt.

The intermittent splicer 1614 receives material A 1610 and material B 1612. After being received by the intermittent splicer 1614, the materials may be fed through a measuring component (not shown) that measures predetermined distances of the materials 1610 and 1612. The measuring component may comprise a toggle wheel, a timing system that measures the rate at which the materials 1610 and 1612 are being received, a caliper system, and/or a vision or optical system to measure the predetermined distances/lengths of a material. After predetermined distances have been measured for material A 1610 and/or material B 1612, the intermittent splicer 1614 may be programmed to terminate material A 1610 and/or material B 1612 at predefined distances.

The intermittent splicer 1614 may use mechanical means such as a knife to terminate (e.g., cut) the materials 1610 and/or 1612. As well (or in the alternative), the intermittent splicer 1614 may use a laser, air, ultrasound, water, heat, chemicals, and the like to terminate the materials 1610 and/or 1612 at defined lengths. Therefore, it is contemplated that the intermittent splicer 1614 is functional to terminate a continuous run of material at an intermediate point in the run. For example, a material may be maintained on a spool that has several hundred feet of continuous material prepared to be fed through the intermittent splicer 1614. In this example, the intermittent splicer 1614 may terminate the material at any point along the length of the several hundred feet of continuous material (any number of times). As a result, any desired length of material may be used at any portion of a resulting combined material resulting from the intermittent splitter 1614.

The intermittent splicer 1614 may be mechanically operated by one or more mechanisms controlled by the logic unit 1624. For example, it is contemplated that the intermittent splicer 1614 may, without intervention from a human operator, terminate a material using an electro-mechanical mechanism (e.g., an actuator, pneumatic, hydraulic, motor) and/or the like. By controlling the terminating portion of the intermittent splicer 1614 by the logic unit 1624, an automated system may be implemented that once started, may not require intervention by a human to manufacture an article having a variety of materials strategically located in a common weft pass (or warp).

Once terminated, the materials 1610 and 1612 may be joined together by the intermittent splicer 1614 to create a combined material 1616. Traditional methods of joining materials 1610 and 1612 together such as fraying the ends of materials 1610 and 1612 and joining the frayed ends may be employed. For example, the materials to be joined may be comprised of a plurality of fibers that when separated (e.g., frayed) at each respective end may then be intermeshed together to form an effective bond between a first end of a first material and a first end of a second material. Additionally, other methods to join the materials 1610 and 1612 may be used such as ultrasonic fusing, lasering, welding, adhesive, heat, wrapping, tying, folding, and/or twisting. As a result, it is contemplated that the intermittent splicer 1614 may terminate a first material at a location along the length of the first material to form a first end and a second end relative to the location of termination. The first end, in this example, is proximate an output region of the intermittent splicer 1614 and the second end is proximate an input region of the intermittent splicer 1614. The first end, in this example, may be joined with a previous second end of a second material (e.g., also proximate the input portion of the intermittent splicer 1614). Further, the second end of the first material may then be joined with a newly created first end (e.g., proximate the output portion of the intermittent splicer 1614) of the second material. As will be discussed hereinafter, it is contemplated that any number of materials in any sequence may be joined.

The intermittent splicer 1614 may also be comprised of one or more maintainers. A maintainer may maintain one or more portions of the materials 1610 and/or 1612 in a desired position during a terminating process and/or during a joining process. For example, it is contemplated that a compression mechanism may hold the first material while terminating the first material. Further, it is contemplated that a maintainer may hold the combined material (e.g., first end of the first material) while being fused with a second end of the second material, even momentarily. However, it is also contemplated that the terminating and/or joining processes may be done on the fly (e.g., as the materials continue to pass through the intermittent splicer 1614).

The intermittent splicer 1614 may also comprise an expelling component (not shown) at the output portion. Once materials 1610 and 1612 have been combined to generate a combined material 1616, the expelling component expels the combined material 1616 from the intermittent splicer 1614. The expelling component may mechanically expel the combined material 1616 using rollers, conveyors, pulleys, and other mechanisms. The expelling component may also/alternatively use, for example, air and/or water to expel the combined material 1616 from the intermittent splicer 1614. Further, it is contemplated that the combined material may be expelled from the intermittent splicer 1614 by gravity and/or a pushing force exerted by an added material portion.

As can be seen from FIG. 16, the combined material 1616 may comprise variable-length segments composed of material A 1610 and material B 1612. For instance, the combined material 1616 may comprise a variable-length segment 1616A composed of material A 1610, a variable-length segment 1616B composed of material B 1612, and a variable-length segment 1616C again composed of material A 1610. Other arrangements are contemplated such as a B-A-B arrangement, an A-B-A-B arrangement, a B-A-B-A arrangement, and so on. When more than two materials are used, the composition of the combined segment 1616 may be adjusted accordingly. By way of illustrative example, if materials A, B, and C are used, one possible composition may comprise A-C-B-A. As can be seen, a near-infinite number of possibilities exist based on the number of materials used, the possible arrangement of materials, and the lengths of each portion of material used.

It is contemplated that the intermittent splicer 1614 may be used in conjunction with any mechanism, such as a loom. Further, it is contemplated that the intermittent splicer 1614 may be used independently of other mechanisms. The intermittent splicer 1614 may also be implemented during any portion of a manufacturing process (e.g., forming the warp, passing the weft).

In an exemplary aspect, once expelled from the intermittent splicer 1614, the combined material 1616 is received by the feeding component 1618 via, for example, an input port. The feeding component 1618 may passively receive the combined material 1616 from the expelling component. The feeding component 1618 may also actively retrieve the combined material 1616 from the intermittent splicer 1614. For instance, the feeding component 1618 may generate a vacuum that draws the combined material 1616 into the feeding component 1618.

The feeding component 1618 is also configured to subsequently feed the combined material 1616 into the loom 1622. The combined material 1616 may be fed in to the loom 1622 as a weft. However, as previously discussed, the combined material may be used in connection with forming a warp beam. If the combined material 1616 is fed in as a weft, the feeding component 1618 may comprise a shuttle, one or more rapiers, an air jet, a water jet, and the like.

The feeding component 1618 may be associated with the dynamic tensioner 1620. The dynamic tensioner 1620 is configured to apply a variable amount of tension to the combined material 1616 as it is being fed into the loom 1622 by the feeding component 1618. The amount of tension applied may depend on the properties of the combined material 1616 as it is passing through the dynamic tensioner 1620. For instance, a smaller degree of tension may be applied to a more elastic segment of the combined material 1616 as compared to the amount of tension applied to a less elastic segment of the combined material 1616. Applying variable amounts of tension depending on the properties of the combined material 1616 helps to ensure that the combined material 1616 is fed smoothly into the loom 1622. Further, it is contemplated that the dynamic tensioner 1620 dynamically adjusts tension based, at least in part, on the characteristics of the combined material 1616 that has already passed through the dynamic tensioner 1620 for a particular weft pass. For example, if a non-elastic portion of material initially passes through the dynamic tensioner 1620, a greater amount of tension may be applied than when an elastic portion or even a subsequent non-elastic portion passes through the dynamic tensioner 1620 on a common weft pass.

The dynamic tensioner 1620 may apply tension by, for example, adjusting the diameter of the input port of the feeding component 1618. In instances where the feeding component 1618 is an air jet, tension may be adjusted by varying the amount of air used to propel the combined material 1616 into the loom 1622. Likewise, if the feeding component 1618 is a water jet, tension may be adjusted by varying the force of the water used to propel the combined material into the loom 1622. Further, it is contemplated that the dynamic tensioner 1620 may be formed from one or more compressive surfaces that apply varied levels of compressive forces on the combined material (e.g., rotating (or not) mated discs in a pulley-like orientation that have graduated mated surfaces that may be separated or closed to impart a desired level of compressive force to a multiple material passing through the graduated mated surfaces).

The dynamic tensioner 1620 may use a caliper-based system to determine when tension should be adjusted and how much the tension should be adjusted. For example, the caliper system may detect a thicker segment of the combined material 1616 and increase the tension applied to the combined material 1616. The dynamic tensioner 1620 may also use a vision/optical system to visually detect a transition from one segment of the combined material 1616 to an adjacent segment of the combined material 1616. The vision/optical system may also detect properties of the segment that determine how much tension should be applied; the tension may then be adjusted accordingly. For instance, the vision/optical system may be configured to detect a color or texture change from one segment to the next of the combined material 1616. Based on this change, the dynamic tensioner 1620 may adjust the tension on the combined material 1616. The dynamic tensioner 1620 may also use a timing system to determine when tension should be adjusted. For example, the combined material 1616 may be expelled from the intermittent splicer 1614 at a constant rate. The dynamic tensioner 1620 may adjust the tension depending on the rate of expulsion. The dynamic tensioner 1620 may also receive inputs from, for example, the logic unit 1624, and adjust the tension based on the received inputs. As a result, it is contemplated that one or more mechanisms may be implemented independently or in concert to adjust the dynamic tensioner 1620 to impart one or more desired characteristics to a resulting product at one or more desired locations.

In one aspect, the dynamic tensioner 1620 may be utilized as a quality control measure. For instance, the dynamic tensioner 1620 may apply an additional amount of tension to the combined material 1616 to adjust the combined material 1616 after it has been fed as a weft through a shed. This may be used to correct minor deviations in alignment of the weft with respect to the pattern that is being woven. For example, if a combined material has a particular portion intended to be placed at a particular location (e.g., at a particular location laterally along the warps), the dynamic tensioner 1620 may impart an elevated level of tension to allow the combined material to slightly extend a length at which it crosses a portion of the warp. Similarly, it is contemplated that the dynamic tensioner 1620 may impart a decreased level of tension to allow the combined material to slightly reduce a length affecting a location as portion crosses a particular warp. Additional mechanisms for adjusting a location of the combined material are contemplated that may not affect the stretch of the combined material (e.g., incorporating an excess portion at either (or both) ends of a weft pass to allow for lateral alignment by the feeding component 1618.

Although the dynamic tensioner 1620 is shown in FIG. 16 as being integrally attached to the feeding component 1618, other arrangements are contemplated. For instance, the dynamic tensioner 1620 may be physically separate from the feeding component 1618. The dynamic tensioner 1620 may be located between the intermittent splicer 1614 and the feeding component 1618. Alternatively, the dynamic tensioner 1620 may be located between the feeding component 1618 and the loom 1622. Further, as previously discussed, it is contemplated that one or more components may be omitted entirely or in part, in an exemplary aspect.

As mentioned, the feeding component 1618 feeds the combined material 1616 into the loom 1622 as either a warp or a weft. The loom 1622 may comprise any type of weaving structure. For example, the loom 1622 may comprise a single or multiple-beam loom, a Jacquard loom, a Dobby loom, and other looms known in the art.

The logic unit 1624 may be programmably-coupled to the intermittent splicer 1614, the feeding component 1618, the dynamic tensioner 1620, and/or the loom 1622 through a wireless or wired connection. The logic unit 1624 may be comprised of a processor and memory to perform one or more of the functions provided herein. Computer-readable media having instructions embodied thereon for performing one or more functions may be implemented with the logic unit 1624 to effectuate one or more of the functions. The logic unit 1624 may instruct these various components based on, for example, a pattern program to produce a woven product conforming to the pattern.

Figure 21:
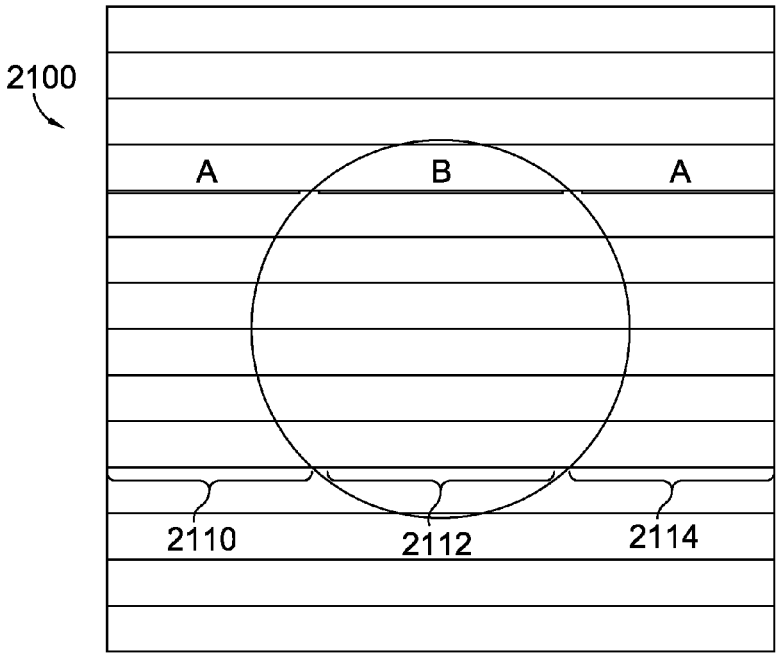
FIG. 21 depicts an exemplary pattern program used by a logic unit in an aspect of the present invention.

FIG. 21 depicts an exemplary pattern program 2100 that may be captured (e.g., by a camera) and processed by the logic unit 1624 to calculate what segment lengths of material A 1610 and/or material B 1612 are needed at each weft (and/or warp) level. The pattern program 2100 comprises a series of lines corresponding to wefts with a pattern superimposed on the lines. The lengths of various segments of the pattern program 2100 may be determined by the logic unit 1624 and subsequently communicated to, for example, the intermittent splicer 1614. For example, the logic unit 1624 may determine a length/distance of segment 2110 (corresponding to material A 1610), segment 2112 (corresponding to material B 1612), and segment 2114 (corresponding to material A 1610). The various lengths/distances of these segments 2110, 2112, and 2114 may be communicated by the logic unit 1624 to the intermittent splicer 1614; the intermittent splicer 1614 then terminates and combines materials based on these inputs.

Further, the logic unit 1624 may also be programmably-coupled to the various vision/optical, timing, toggle wheel, and caliper-based systems associated with these components. The logic unit 1624 may, in one aspect, receive inputs from the various vision/optical, timing, toggle wheel, and caliper-based systems, and, based on these inputs and a programmed pattern/structure, instruct the intermittent splicer 1614 to terminate the material A 1610 or the material B 1612 at a predetermined location. Further, the logic unit 1624 may instruct the dynamic tensioner 1620 to apply a predetermined amount of tension to the combined material 1616 based on received inputs. Any and all such aspects are within the scope of the invention.

As provided herein, it is contemplated that the logic unit 1624 may be comprised of a computing device. Therefore, the logic unit 1624 may maintain one or more set of instructions useable by one or more components (e.g., intermittent splicer, loom, dynamic tensioner, Jacquard loom, measurement components, quality control components) to manufacture an article. The instructions may include logic capable of coordinating the automatic terminating and splicing of materials such that when inserted through a shed may be positioned in a defined location relative to the warp beam. Further, the logic may ensure the proper alignment and positioning of one or more portions of a multiple material element as integrated into an article.

The logic unit 1624 may store the instructions or may receive the instructions. For example, it is contemplated that the logic unit 1624 may be connected via a network to one or more computing devices that maintain parameters to complete a particular article. Upon receiving an indication to manufacture a particular article, the proper instructions (or portions thereof) are communicated to the logic unit 1624 for controlling one or more components to effectuate the manufacturing of the article. As such, it is contemplated that the logic unit 1624 may be responsible for ensuring that typically disparate components may operate in concert to automatically produce an article through the coordination of one or more functions of each of the components.

Figure 17:
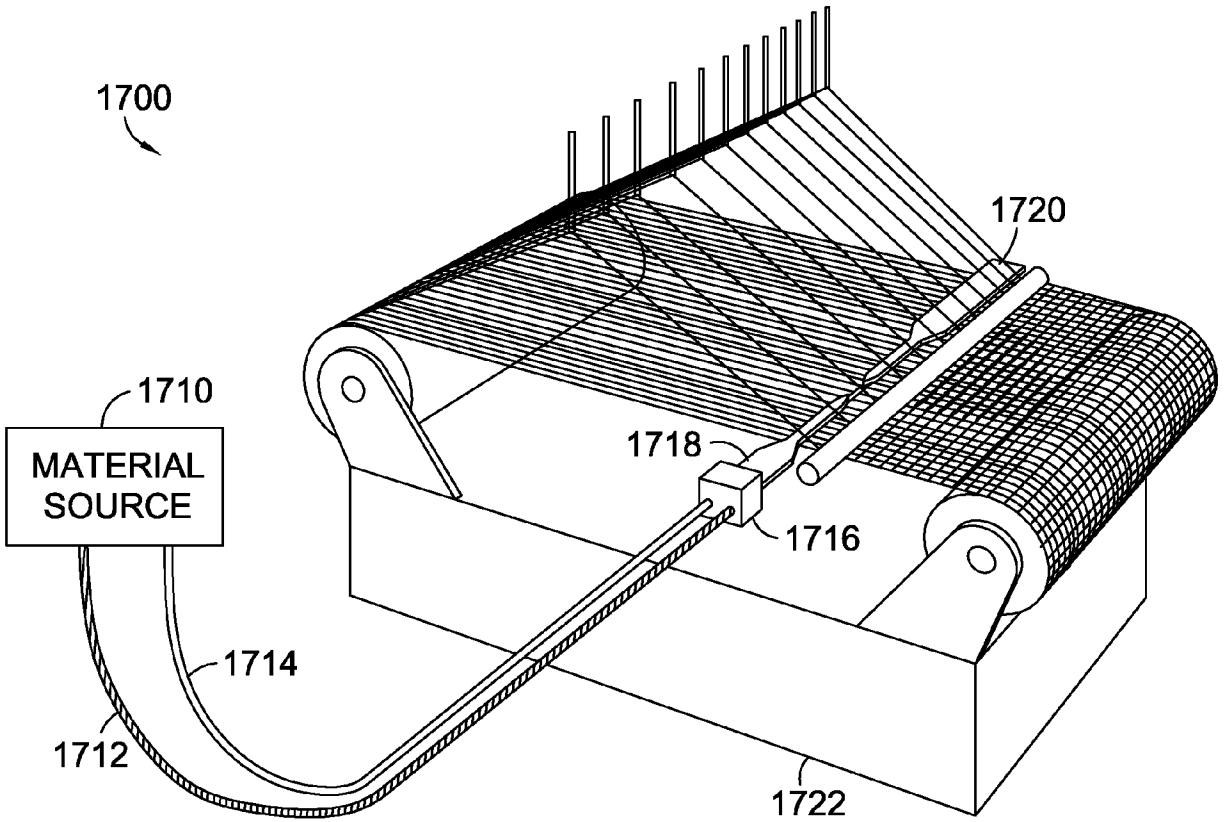
FIG. 17 depicts an exemplary intermittent weaving splicer in association with a feeding component in an aspect of the present invention.

Turning now to FIG. 17, another aspect of the invention is illustrated. FIG. 17 depicts a system 1700 comprising a material source 1710, a material 1712, a material 1714, an intermittent splicer 1716 that is integrally connected to a feeding component 1718, and a receiving component 1720. The feeding component 1718 and the receiving component 1720 may comprise a first rapier and a second rapier. Traditional weaving technology employs rapiers to feed wefts across a shed. A first rapier feeding a weft is met by a second rapier at a point across the width of the weave. The second rapier takes the weft and completes the journey of the weft across the width of the weave (e.g., the length of the warp beam).

The feeding component 1718 may be dynamically programmed (by, for example, a logic unit) to deliver the weft to the receiving component 1720 at varying distances along the width of the weave instead of at the midway point of the weave. Further, the intermittent splicer 1716 may be programmed to terminate material 1712 and/or material 1714 and generate a combined material prior to the feeding component 1718 meeting the receiving component 1720 and transferring the combined material.

Figure 18:
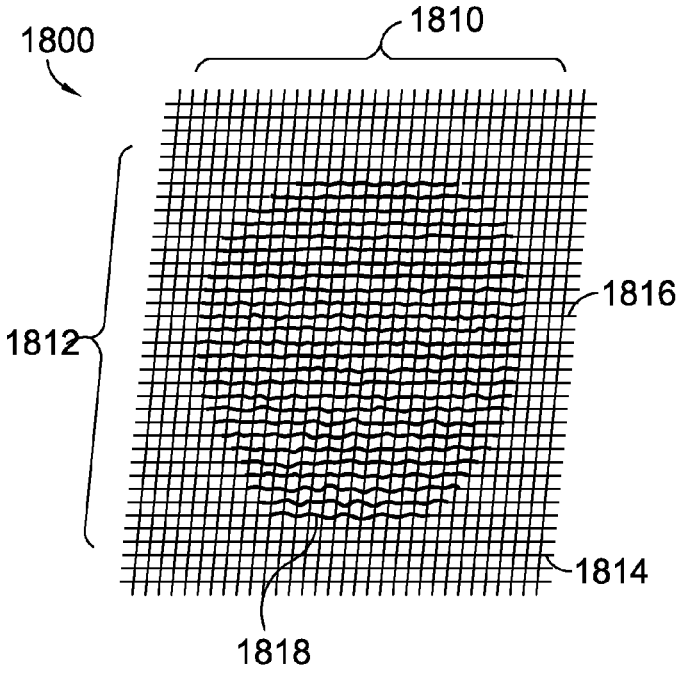
FIG. 18 depicts an exemplary portion of a woven product in an aspect of the present invention.

FIG. 18 depicts a close-up view of an exemplary woven product 1800 that may be produced by the system 1600. The woven product 1800 comprises a series of warp threads 1810. Although the term "thread" is used for convenience sake, it is contemplated that the term "thread" may comprise any type of material discussed previously, including fabric materials, plastic materials, synthetic materials, metal materials, and the like. The woven product 1800 also comprises a series of weft threads 1812. In this example, a portion of the weft threads 1812 comprises combined material weft threads generated by, for example, an intermittent splicer such as the intermittent splicer 1614 of FIG. 16. Thread 1814 provides an example of a weft thread that is comprised of one material, while thread 1816 illustrates a weft thread comprised of more than one material.

The weft threads 1812 are woven to produce an area 1818. The area 1818 may have different functional properties as compared to the remainder of the woven product 1800. For instance, the area 1818 may have a greater amount of stretch as compared to the remainder of the woven product 1800. In another example, the area 1818 may be composed of thermoreactive, and/or chemical reactive materials (e.g., water soluble). These materials may be treated with an appropriate agent (heat, water, and/or chemical) to eliminate the area 1818 or to further change the functional properties of the area 1818.

Additionally, the area 1818 may have different aesthetic properties as compared to the remainder of the woven product 1800. For instance, the area 1818 may be a different color than the remainder of the woven product 1800, or be composed of weft threads having a matte or shiny finish. The area 1818 may comprise a logo, graphic elements, geometric-shaped patterns, or organically-shaped patterns. Further, the area 1818 may be woven from weft threads having a different diameter as compared to the remainder of the woven product 1800. This may help to impart a three-dimensional aspect to the area 1818. Any and all such variations are within the scope of the invention.

Figure 20:
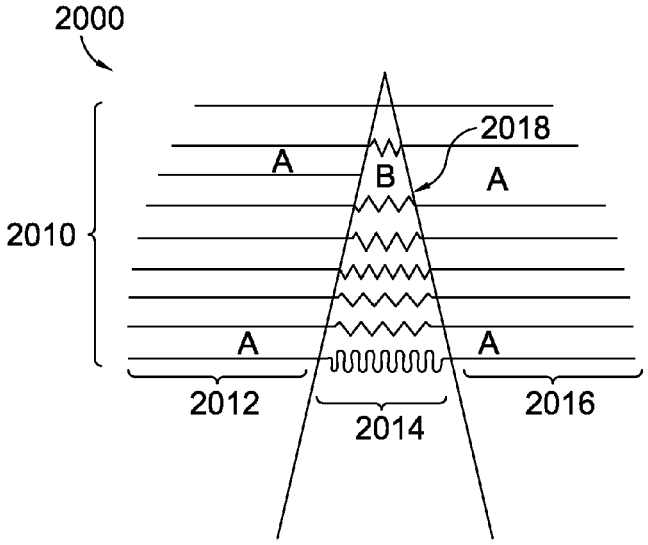
FIG. 20 depicts an exemplary portion of a woven product in an aspect of the present invention.

FIG. 20 depicts another exemplary portion of a product 2000 that may be produced by the system 1600. The focus of FIG. 20 is on the combined material that makes up the weft threads 2010. Because of this, the warp threads are not depicted. The combined material that makes up the weft threads 2010 comprises a first segment 2012 of a first material (material A), a second segment 2014 of a second material (material B), and a third segment 2016 of the first material (material A). The second material in the second segment 2014 may comprise crimped yarn. Examples of crimped yarn include polyester fill used for insulation in jackets or as stuffing in pillows. This type of yarn is generally resistant to stretching which gives it loft and volume. However, crimped yarn typically stretches as heat is applied; the heat causing the crimped yarn to lose its crimp. Taking advantage of these properties of crimped yarn, heat may be selectively applied to the portion of the product 2000 containing the crimped yarn (i.e., area 2018). The application of heat may cause the area 2018 to elongate or stretch which adds three-dimensionality to the product 2000. One example where this type of process is useful is in the creation of a heel portion of a shoe upper.

Figure 19:
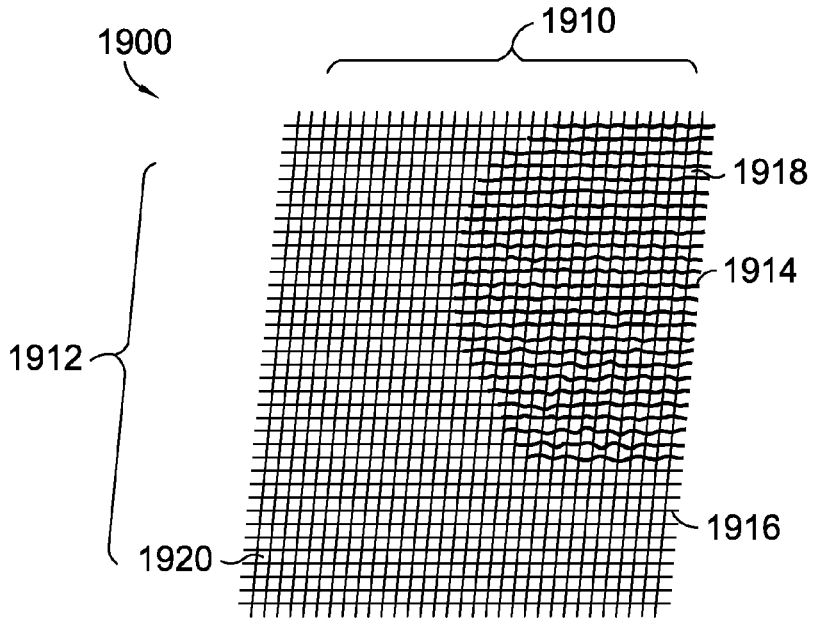
FIG. 19 depicts an exemplary portion of a woven product in an aspect of the present invention.

FIG. 19 depicts an exemplary portion of a woven product 1900 that may be produced by the system 1700. The woven product comprises a set of warp threads 1910 and a set of weft threads 1912. Like above, the term "thread" is meant to encompass any number of materials. A portion of the weft threads 1912 comprises weft threads of combined materials generated by an intermittent splicer such as the intermittent splicer 1716 of FIG. 17. Weft thread 1914 is an example of a weft thread of combined materials. Additionally, a portion of the weft threads 1912 comprises weft threads composed of one type of material (for example, weft thread 1916).

As described above, the system 1700 comprises a feeding component (in this case, a first rapier) that may be dynamically adjusted to deliver weft threads different distances along the width of the weave. A corresponding receiving component (a second rapier) may also be dynamically adjusted to receive the weft thread at the point of handoff from the feeding component. An intermittent splicer may generate a weft of combined materials prior to the receiving component receiving the weft thread from the feeding component. The result is the ability to produce a variety of geometric or organically-shaped patterns having different functional and/or aesthetic properties. For instance, area 1918 of the woven product 1900 is composed of weft threads having different properties from the weft threads that make up the area 1920. Like above with respect to FIGS. 18 and 20, the weft threads in the areas 1918 and 1920 may have different functional properties and/or different aesthetic properties.

As depicted, it is contemplated that any combination of combined materials may be implemented at any location to form a product having organic-shaped characteristic portions imparted by selectively changing underlying materials of a weft. For example, the characteristic portions may have varied aesthetic and/or functional characteristics at specified locations. The ability to selectively impart desired characteristics intermittently in a weft pass (as opposed to having a uniform characteristic along a complete weft pass) provides increased control of a weaving process.

Figure 22:
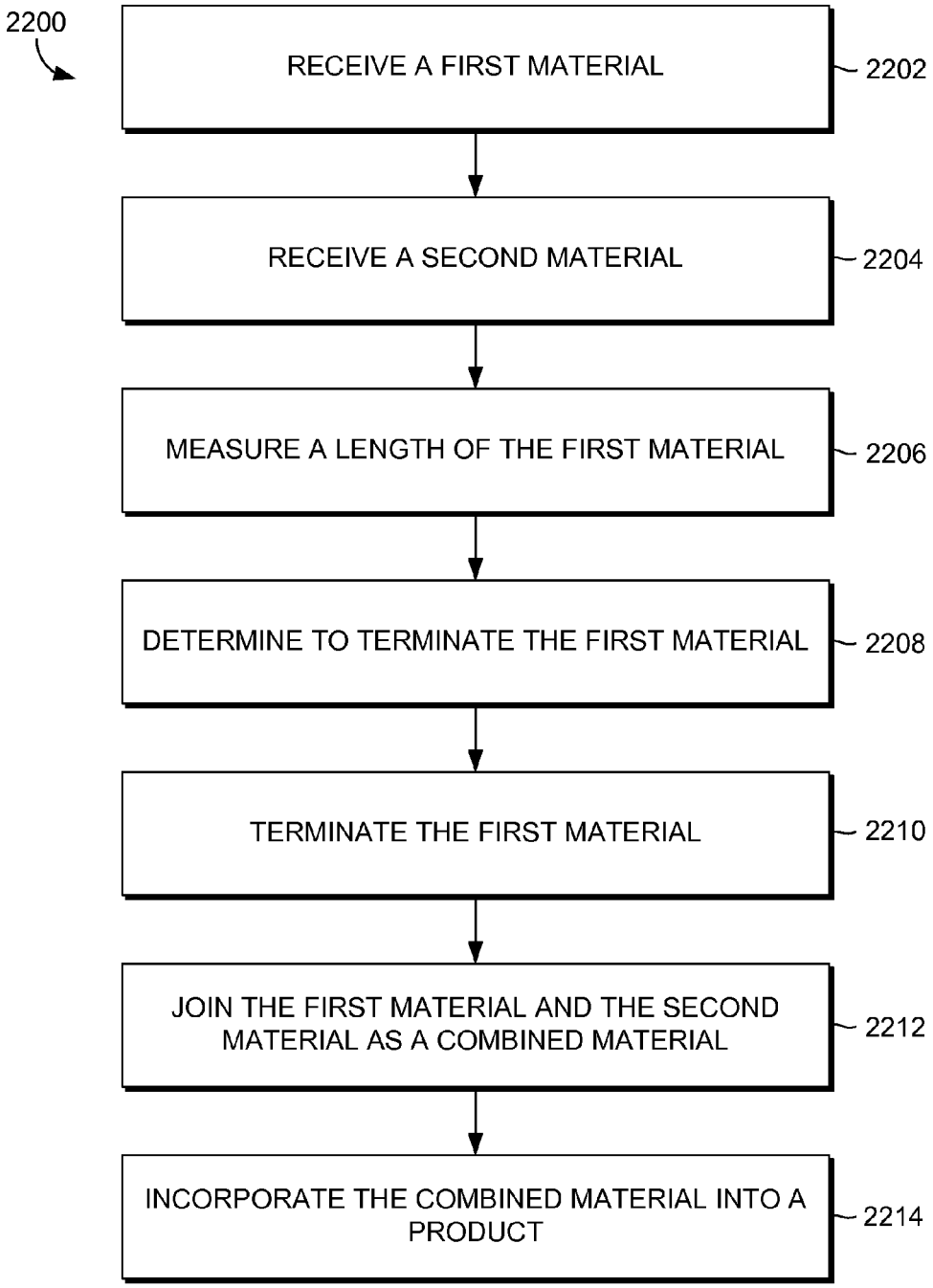
FIG. 22 depicts an exemplary flow diagram illustrating a method of creating a combined material from a first material input and a second material input in an aspect of the present invention.

FIG. 22 depicts a block diagram illustrating an exemplary method 2200 for utilizing an intermittent splicer, in accordance with aspects of the present invention. At a block 2202, a first material is received at the intermittent splicer. As previously discussed, the material may be any material, such as a yarn, thread, webbing, and the like. Receiving of a material may include a portion of the material entering one or more portions of the intermittent splicer. At a block 2204, a second material is received at the intermittent splicer. As previously discussed, any number of materials may be received/utilized at/by an intermittent splicer.

At a block 2206 a length of the first material is measured. The length may be measured to result in a particular length of the first material at a particular location within a resulting combined material. The measuring may be accomplished using mechanical mechanisms, timing mechanisms, optical mechanisms, and other techniques for measuring a length of a material. At a block 2208, a determination is made to terminate the first. The determination may be accomplished utilizing a logic unit that controls a terminator of the intermittent splicer. The determination may be made, at least in part, based on the measured length of the first material and a desired length to be used in a resulting combined material. Further, the logic unit may rely on a programmed pattern that coordinates the intermittent splicer and one or more manufacturing machines (e.g., loom, knitting machine, braider), which may be used in conjunction with the intermittent splicer. Once a determination to terminate is made at the block 2208, at a block 2210 the first material is terminated. The termination may be effected by a mechanical cutting, a chemical process, a heating process, an ultrasonic process, and/or the like.

At a block 2212, the first material and the second material are joined. The joining of the first and second materials may rely on a mechanical connection among elements (e.g., fibers) of each of the materials. Additionally, it is contemplated that other bonding techniques may be used to join the first material and the second material (e.g., welding, adhesive). Once the first material and the second material are joined, the resulting combined material may be incorporated into a product at a block 2214. For example, the resulting product may be formed using a number of machines and techniques, such as a loom for a woven article, a knitting machine for a knit article, a braiding machine for a braided article, and the like.

Finishing Device

At a high level, the aspects of the present invention are directed to one or more finishing devices that can dynamically finish one side of a woven product independently of a second side of the woven product. For example, a right side and a left side of a woven article may be finished independently of one another. The sides may be finished in a non-linear fashion, such as an organic geometry, which eliminates the need for at least some post-processing pattern cutting. Additionally, one or more finishing devices of the present invention can be dynamically (e.g., moveably) positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

Turning now to FIG. 1, a top view of a loom 100 is depicted. The loom 100 is exemplary in nature and is used to illustrate certain aspects of one or more finishing devices. The loom 100 may comprise any type of weaving structure. For example, the loom 100 may comprise a single or multiple beam loom, a Jacquard loom, a Dobby loom, and other looms known in the art.

The loom 100 comprises a beam 110 that holds a set of warp threads 112 in tension. Although the term "thread" is used throughout this Specification for convenience sake, it is contemplated that the term "thread" may comprise any type of material (e.g., thread, yarn, string, braided material, extruded material, pulled material, spun material, and the like) formed from any substance including fabric materials, plastic materials, synthetic materials, metal materials, engineered materials, and the like. The loom also includes a first finishing device 116 and a second finishing device 118 that are positioned along the lateral edges of the loom 100 adjacent to a woven panel 124 (the woven panel 124 comprising warp threads interwoven with weft threads). While only two finishing devices are illustrated with respect to FIG. 1, it is contemplated that any number and combination of finishing devices may be implemented in exemplary aspects. Further, it is contemplated that a finishing device may be oriented in a variety of positions to finish in a variety of manners. For example, a tucker may be oriented to the left to form a right finished edge, or the tucker may be oriented to the right to form a left finished edge. The combination of finishing mechanisms is near limitless when considering types, locations, numbers, and orientations.

The finishing devices 116 and 118 may be manually attached to a supporting frame of the loom (not shown). Alternatively, the finishing devices 116 and 118 may be positioned on one or more positioning mechanisms. The positioning mechanisms may be functional for moving the finishing devices in any direction and/or rotation. For example, the positioning mechanisms may be functional for moving one or more finishing devices in a vertical, horizontal, and/or pivoting manner. In an exemplary aspect, it is contemplated that the positioning mechanism may be comprised of rotating arms that bring the finishing devices 116 and 118 in and out of position on the loom 100 and move the finishing devices 116 and 118 laterally in the direction of the weft threads. The rotating arms may raise and lower the finishing devices 116 and 118 in order to operate on different panels/layers of the woven product. In other contemplated aspects, the positioning mechanism may implement one or more screw drives, conveyors, belts, rapiers, pneumatics, hydraulics, and the like. Other ways of positioning finishing devices known in the art are contemplated to be within the scope of the invention.

With continued reference to FIG. 1, the finishing devices 116 and 118 are used to create a finished edge(s) of the woven panel 124 to create edge stability and prevent fraying of the edges. Edge finishing is important to maintain product integrity during post-weaving processing steps. The finishing devices 116 and 118 may use a tucker or a leno warp twister to create the selvedge or finished edge. Additional ways of creating a finished edge include singeing the edges with a singeing device especially when thermoreactive materials are being woven, and using a sintering laser when chemically-reactive materials are being woven. Other forms of finishing are contemplated, such as ultrasonic, binding, surging, and the like.

The finishing devices 116 and 118 may be programmed to dynamically move laterally in and out of the woven panel 124 (in the direction of the weft threads) as the woven panel 124 is being fed through the finishing devices 116 and 118. The lateral movement of the finishing devices 116 and 118 may be changed with each weft that has been woven. This dynamic movement allows the woven panel 124 to be generated with a finished edge in any possible shape—not just a linear shape—as the woven panel is formed. Vision and/or optical systems may be used in conjunction with the finishing devices 116 and 118 to monitor the lateral movements of the finishing devices 116 and 118 with respect to the woven panel 124.

In an exemplary aspect, it is contemplated that the finishing device operating on one or more wefts finishes the one or more wefts while allowing one or more warps not interwoven with the one or more wefts to maintain continuity. Stated differently, when an organic lateral edge is formed with wefts finished at a location inside the beam width, warp threads will extend from the finished edge toward the lateral edge of the beam. These warp threads may not be terminated until post processing. The delay in terminating may allow for later woven wefts to utilize these wefts. However, it is also contemplated that warp threads outside the finished edge may be terminated at any point in the weaving process.

The finishing devices 116 and 118 may be programmably-coupled to a logic unit 114 by a wired or wireless connection. The logic unit 114 may execute a pattern program and instruct the finishing devices 116 and 118 based on the pattern program. Further, the logic unit 114 may also be programmably-coupled to the vision and/or optical systems of the finishing devices 116 and 118. The logic unit 114 may receive inputs from the vision and/or optical systems and, based on these inputs, instruct the finishing devices 116 and 118 to move laterally to a predetermined location based on the pattern program. Weaving and finishing the woven panel 124 according to the pattern program reduces the need to manually create the pattern shape after a panel has been woven.

The logic unit 114 may utilize one or more computer readable media having instructions maintained thereon for controlling one or more components. For example, it is contemplated that the logic unit 114 may have a processor and memory functional for executing instructions embodied on the computer readable media, such that by executing those instructions, one or more finishing devices, looms, vision systems, and the like may form a woven article with a finished edge. It is contemplated that a set of instructions identify a location at which a finishing device is to finish a woven article to produce a desired result. The instructions may be stored at the logic unit 114 and/or at a remote computing device, which communicates via a network connection (wired or wireless).

In addition to the logic unit 114, it is contemplated that the finishing mechanism and the positioning mechanism of a finishing device may have one or more computing mechanisms associated therewith. For example, the positioning mechanism may have a microcontroller associated that monitors the position and controls the drive system that operates the positioning mechanism. Similarly, the finishing mechanism may also have a microcontroller associated that controls one or more functions of the finisher. The finishing mechanism microcontroller may be responsible for ensuring components of the finishing mechanism are engaged. Together, a combination of logic unit, microcontrollers, and other components may work in concert to finish one or more edges, including internal edges, without direct human intervention.

The finishing devices 116 and 118 may be programmed to operate independently of each other. The result is a first edge 120 of the woven panel 124 that may have a different shape than a second edge 122 of the woven panel 124. As previously discussed, it is contemplated that the finishing device 116 and the finishing device 118 each have a positioning mechanism that operates independently of each other. As a result, each finishing device may move in a lateral direction that does not directly correlate with the other, when desired.

Figure 2:
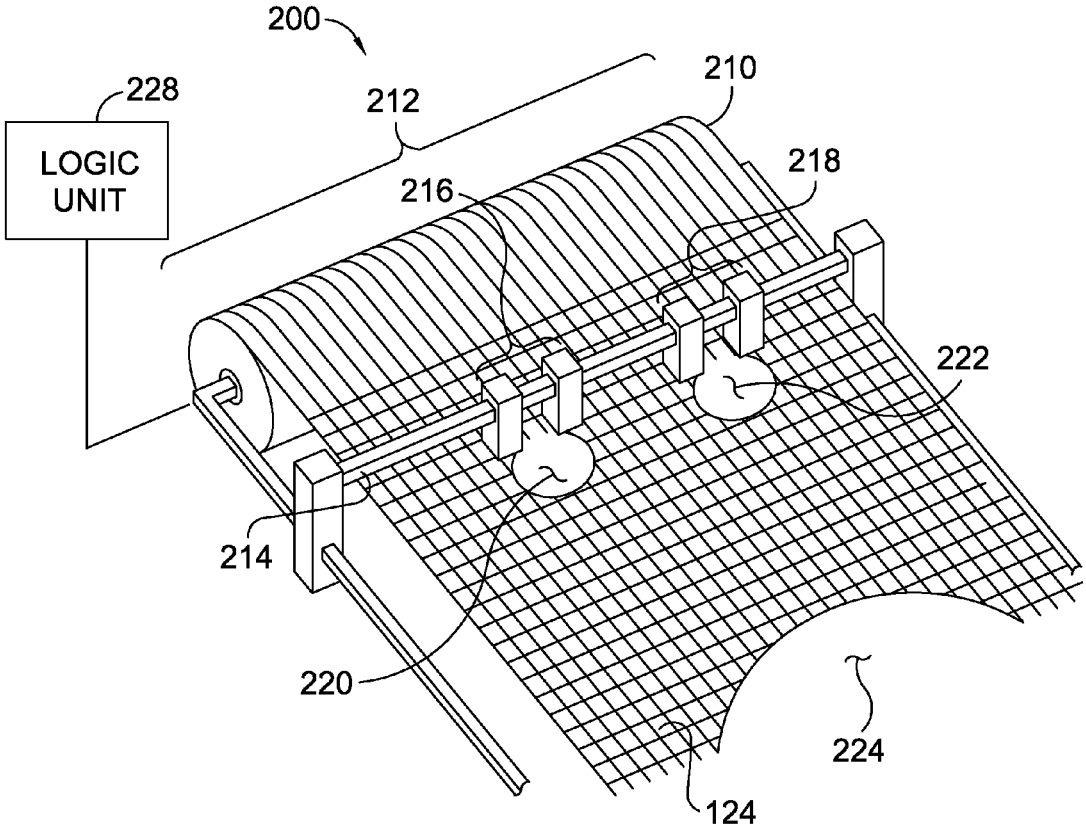
FIG. 2 depicts a top view of a loom with a plurality of interior finishing devices in an aspect of the present invention.

Turning now to FIG. 2, a top view of a loom 200 having a plurality of finishing devices located at an interior portion of a woven panel 226 is depicted. The loom 200 is exemplary in nature and is used to illustrate certain aspects of one or more finishing devices. The loom 200 may comprise any type of weaving structure. For example, the loom 200 may comprise a single or multiple beam loom, a Jacquard loom, a Dobby loom, and other looms known in the art.

The loom 200 comprises a beam 210 that holds a set of warp threads 212 in tension. As previously discussed, the term "thread" is not limiting, but instead used for the convenience of this description. The loom 200 also comprises a support beam 214 mounted to the frame of the loom 200. A first set of finishing devices 216 and a second set of finishing devices 218 are attached to the support beam 214.

The first and second set of finishing devices 216 and 218 may be movable along the support beam 214 through, for example, the use of a screw drive or rollers, as previously discussed. The first and second set of finishing devices 216 and 218 may be able to rotate around the support beam 214 so that the functional aspects of the finishing devices 216 and 218 may be alternately aligned in the direction of the weft threads or the warp threads. Alternatively, one finishing device of the first set of finishing devices 216 may be oriented to operate in the direction of the weft threads (e.g., a tucker), and the second finishing device of the set of finishing devices 216 may be oriented to operate in the direction of the warp threads (e.g., a leno twist); the same holds true for the second set of finishing devices 218. The first and second set of finishing devices 216 and 218 may be able to pivot out of the way when not in use.

In another exemplary arrangement that is not depicted, the first set and the second set of finishing devices 216 and 218 may be mounted on movable arms that act to raise, lower, or laterally move the first and second set of finishing devices 216 and 218. Further, the first set of finishing devices 216 may be operated and moved independently of the second set of finishing devices 218. Although only two sets of finishing devices are shown in FIG. 2, it is contemplated that a plurality of sets of finishing devices may be employed to generate a woven product. Any and all such aspects are within the scope of the invention.

As the loom 200 weaves the woven panel 226, the first and second set of finishing devices 216 and 218 cut and finish warp and/or weft threads to create apertures in the woven panel 226. For instance, as the loom 200 weaves the woven panel 226, the finishing devices 216 and 218 move laterally back and forth along a weft of the woven panel 226. The finishing devices 216 and 218 cut the weft threads and any warp threads 212 that are encountered and simultaneously finish the cut edges of the threads. The cut material may be finished by any of the methods outlined above with respect to FIG. 1 (tucking, leno warp twisting, singeing, sintering, and the like). The sets of finishing devices 216 and 218 may have associated vision and/or optical systems to monitor the lateral movements of the finishing devices 216 and 218 with respect to the woven panel 226. However, as previously discussed, it is contemplated that the weft threads may be cut and finished while maintaining the warp threads for continuity purposes, in an exemplary aspect.

FIG. 2 illustrates two apertures 220 and 222 that are simultaneously being created by the first and second set of finishing devices 216 and 218. As can be seen, the apertures 220 and 222 are finished both in the direction of the warp threads 212 and in the direction of the weft threads. FIG. 2 also illustrates an additional aperture 224 that was created at an earlier point in the weaving process. The aperture 224 was created by one set of finishing devices (216 or 218), thus illustrating that the sets of finishing devices 216 and 218 may operate independently of each other. In this example, a cutting mechanism associated with or independent of the finishing device(s) may terminate (using any known method) those threads that form at least a portion of an internal aperture. For example, it is contemplated that the finishing devices 216 and 216 cut and finish the weft threads and the warp threads that form the internal portion of, for example, the aperture 220. In this example, the finishing devices may not form the aperture 220 until at least one weft has been inserted into the shed of the woven article that will extend across those warps that may be terminated.

The sets of finishing devices 216 and 218 may be programmably-coupled to a logic unit 228 by a wired or wireless connection. The logic unit 228 may execute a pattern program and instruct the sets of finishing devices 216 and 218 based on the pattern program. Further, the logic unit 228 may also be programmably-coupled to the vision and/or optical systems of the sets of finishing devices 216 and 218. The logic unit 228 may receive inputs from the vision and/or optical systems and, based on these inputs, instruct the sets of finishing devices 216 and 218 to move laterally a predetermined distance based on the pattern program. Weaving and finishing the woven panel 226 according to the pattern program reduces the need to manually create the apertures after a panel has been woven. Further, the systems depicted in FIGS. 1 and 2 enable the weaving and finishing of a variety of different patterns including organically-shaped patterns.

The finishing devices discussed above with respect to FIGS. 1 and 2 (i.e., finishing devices 116 and 118, and the sets of finishing devices 216 and 218) may be used on looms with multiple panel weaving capabilities. While weaving multiple panels simultaneously, the finishing devices may create apertures in the interior portion of one or more panels and create different lateral margins on each of the one or more panels. The edges of the apertures and the lateral margins may be finished by the finishing devices. In one aspect, the edges of the apertures may be woven to a corresponding panel(s) that is above or below the panel with the aperture to create one or more channels or pockets. Any and all such aspects are within the scope of the invention.

Figure 3:
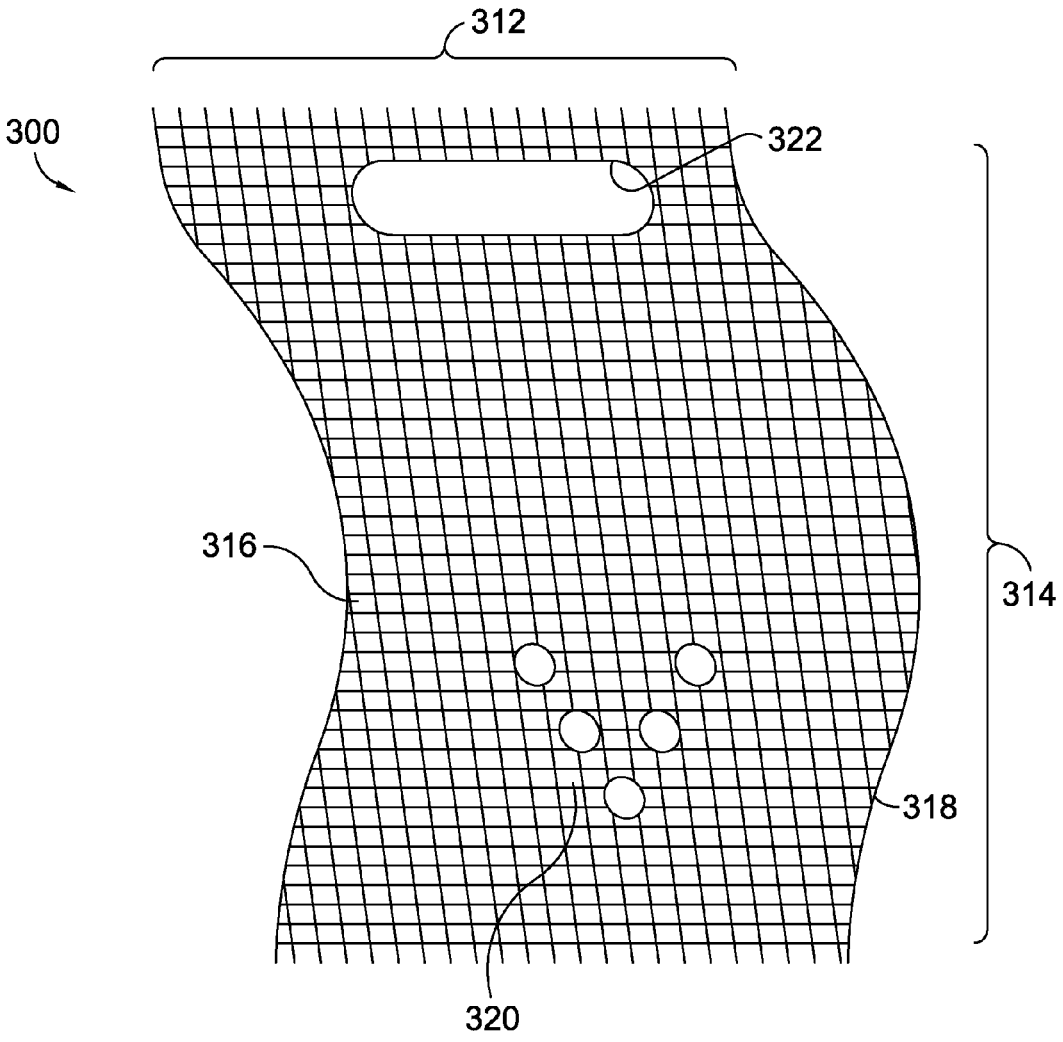
FIG. 3 depicts a portion of an exemplary woven product having lateral finished edges and interior apertures with finished edges in an aspect of the present invention.

FIG. 3 depicts a close-up view of a portion of an exemplary woven product 300 that may be produced by the finishing devices discussed above. The woven product comprises a series of warp threads 312 and a series of weft threads 314. Lateral finishing devices, such as the finishing devices 116 and 118 of FIG. 1, may be utilized to create lateral edges 316 and 318 of the woven product 300. The lateral edges 316 and 318 may be organically-shaped or geometrically-shaped. Further, the lateral edge 316 may be shaped the same as or different from the lateral edge 318. The lateral finishing devices may finish the lateral edges 316 and 318 using a tucker, a leno warp twister, a singeing device, a sintering laser, and the like.

Apertures 320 may be created by one or multiple sets of interior finishing devices as discussed above with respect to FIG. 2. The apertures 320 may be small to create a mesh-like pattern, medium-sized to create functional apertures for cording or webbing to pass through, or they can be large allowing pattern parts to separate and connect. The edges of the apertures 320 may be finished. The edges of the apertures 320 may be woven to the edges of apertures in woven panels situated above and below the woven product 300. The weaving together of multiple apertures stacked on top of each other may help to create channels through the woven product 300.

The woven product 300 also comprises an additional aperture 322 that may be constructed by one or more sets of finishing devices. The edges of the aperture 322 may be woven to panels above and below the aperture 322 to create a pocket in the woven product 300. Similarly, a portion of the edges of the aperture 322 may be woven to a panel below the aperture 322 to create an accessible pocket.

Further, it is contemplated that a warp thread separator may be used in conjunction with one or more components of a finishing device. For example, it is contemplated that a warp thread separator may be a wedge-like structure that is inserted between two warp threads that will eventually form the lateral edges of an internal aperture. By forcibly parting two traditionally parallel warp threads prior to (or contemporaneously with) the finishing of weft threads, an aperture may be formed that maintains the continuity of warp threads throughout the warp length of the woven article. It is contemplated that the finishing of the weft threads around each of the separated warp threads maintains the separated warp threads in a desired position, which may be in a non-parallel orientation.

In another exemplary aspect, it is contemplated that a series of finishing devices may be implemented to result in a desired aperture. For example, a leno warp twister may finish a plurality of warp threads in a number of substantially parallel twisted warps. Once the leno warp twister has twisted the warps, another finishing device may be implemented that cuts wefts between two substantially parallel twisted warps and proceeds to tuck each respective new weft end about a proper twisted warp. Further, it is contemplated that a warp separator may separate the two substantially parallel twisted warp groupings as the tucking of the wefts occurs.

A hubless leno warp twister is contemplated as being positioned on one or more internal (medial of the lateral-most warp threads) warp threads. In this example, when an aperture is desired at an internal position of the woven article, the hubless leno warp twister may be positioned on the corresponding warps that are positioned in the lateral direction of the aperture. In this example, the finishing device may include a tucker and a cutter that are functional for forming an aperture between the twisted warp groupings.

Figure 4:
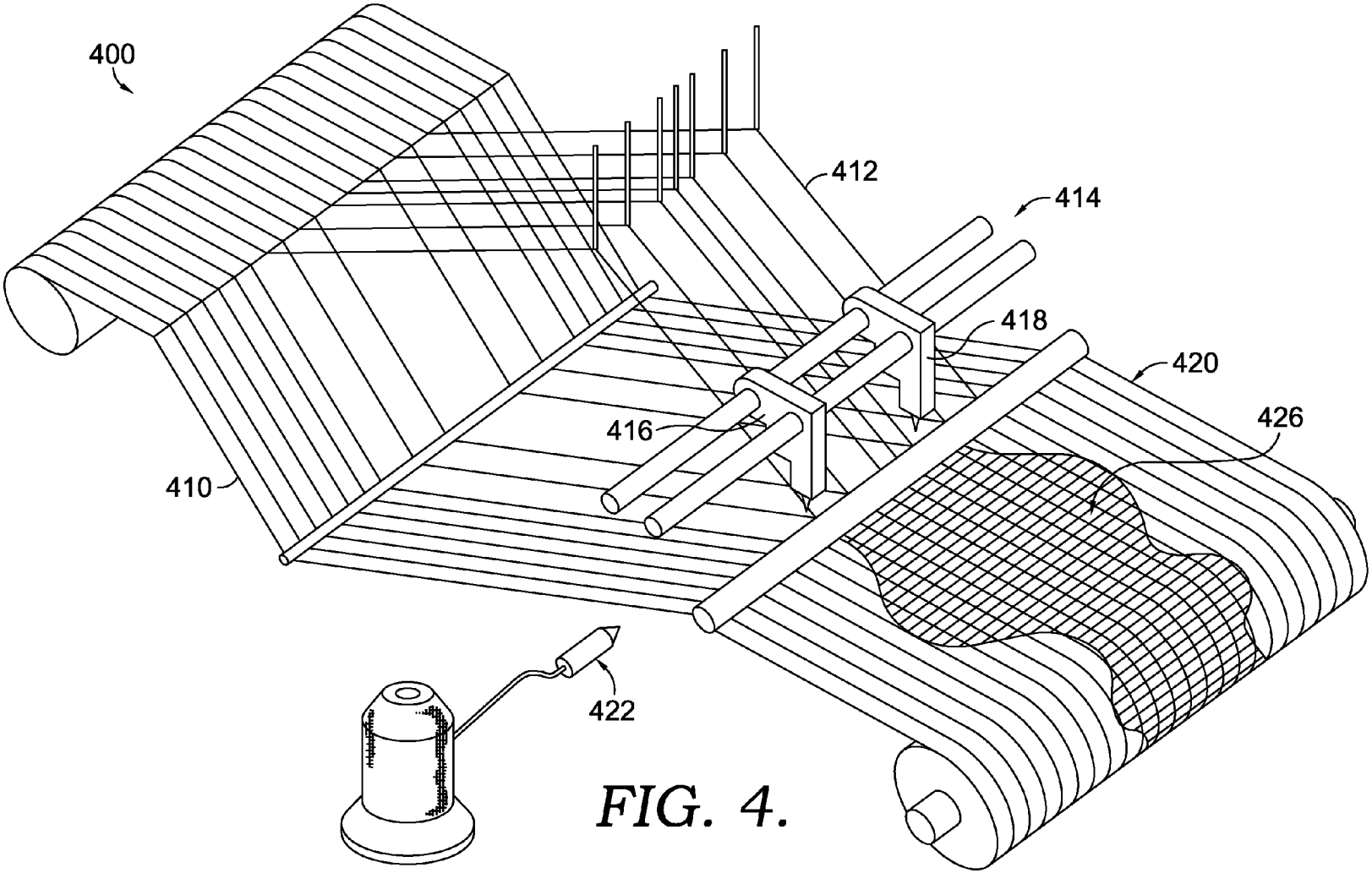
FIG. 4 depicts a loom with lateral finishing devices in an aspect of the present invention.

FIG. 4 depicts a top view of a loom 400 having a plurality of finishing devices and a Jacquard device, in accordance with aspects of the present invention. The loom 400 is comprised of a warp beam constructed with a plurality of warp threads (e.g., warp threads 410 and 412). The warp threads may be selectively positioned up or down based on manipulation by Jacquard needles 424. In the present illustration, only those Jacquard needles maintain warps in an up position are illustrated, but it is contemplated that even those warps in the down position also are associated with Jacquard needles. The loom 400 incorporates a first finishing device 416 and a second finishing device 418. The finishing devices are positionable dynamically using a positioning mechanism 414. As illustrated in this exemplary aspect, the positioning mechanism is comprised of two rods, which may be screw drives. For example, it is contemplated that the first finishing mechanism 416 is actively engaged to a first of the two rods and passively engaged with the second rod. Similarly, it is contemplated that the second finishing mechanism 418 is actively engaged with the second of the two rods and passively engaged with the first rod. When actively engaged with a rod, the rod is functional to move the finishing device laterally (or pivotally). When passively engaged, the finishing mechanism may be allowed to be supported by the rod, but not actively positioned by that rod.

As depicted in FIG. 4, warp threads that are not interwoven with weft threads to form a portion of a woven article 426 may be left in a down position (or any position) when a weft thread, as provided by a weft loader 422, is being inserted into the warp threads. Further, it is contemplated that the warp threads not interwoven with weft threads (e.g., warp thread 420) may be allowed to maintain continuity for the length of the weaving process to ensure consistent tension and other characteristics. As such, it is contemplated that the warp threads not interwoven with weft threads may be separated from the woven article 426 in a post processing procedure. Further, the non-interwoven warp threads may be removed at the time of forming the woven article 426, in an exemplary aspect.

In the illustrated aspect of FIG. 4, the finishing devices 416 and 418 are positioned proximate the weft insertion place; however, it is contemplated that one or more of the finishing devices may be positioned at any location. For example, a warp finishing device may be positioned prior to the insertion of the weft thread. Further, it is contemplated that a weft finishing device may be positioned at a location post-weft insertion and weft packing. Therefore, one or more finishing devices may be located at any location along the formation of a woven article.

As previously discussed, it is contemplated that a number of possible internal apertures may be formed using one or more finishing devices. For example, FIGS. 5-11 illustrate various arrangements and techniques for forming an aperture in an internal portion of a woven article, in accordance with aspects of the present invention.

Figure 5:
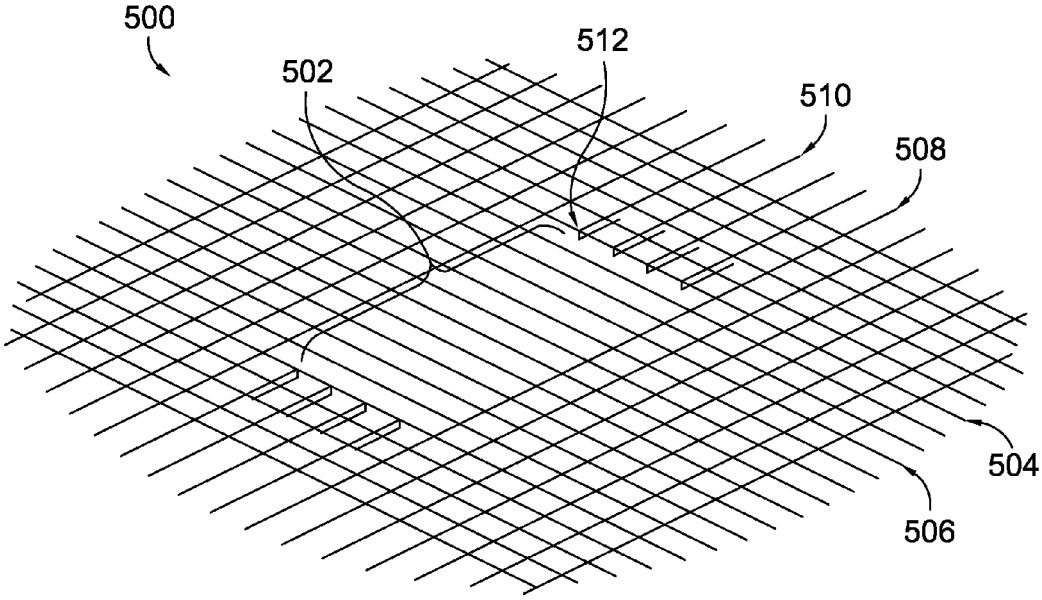
FIGS. 5-11 depict exemplary portions of a woven articles comprised of internal apertures formed, at least in part, with one or more finishing devices, in accordance with aspects of the present invention.

FIG. 5 depicts a portion of a woven article 500 comprised of an internal aperture 502, in accordance with aspects of the present invention. The aperture 502, in this example, is formed by finishing one or more weft (i.e., fill) threads to form a portion of the aperture 502 perimeter. In this illustration, a series of warp threads, such as a warp thread 504 and a warp thread 506 extend through the woven article 500. The warp threads are interwoven with a series of weft threads. A portion of the weft threads, such as weft thread 510, are finished at an internal portion of the woven article. Other weft threads, such as a weft thread 508 extend the length of the warp beam, in this example.

The aperture 502 is formed by finishing (e.g., tucking) the weft threads that would otherwise cross a desired internal aperture. For example, the weft 510 is tucked around the warp 504 at a tuck 512. The finishing may occur during the weaving process (e.g., prior to packing by a comb, subsequent to packing by a comb) and/or the finishing may occur as a post-process procedure. The aperture 502 is formed with substantially linear perimeter edges. Other apertures discussed herein (e.g., an aperture 602 of FIG. 6) may have gradient edges on the perimeter. It is contemplated that any form of finishing may be implemented on the warps and/or the wefts (and in any combination). For example, the various threads may be finished with a fold and weld process, a tucking process, a singeing process, an activation process (e.g., heat activation), and other finishing techniques discussed herein.

Figure 6:
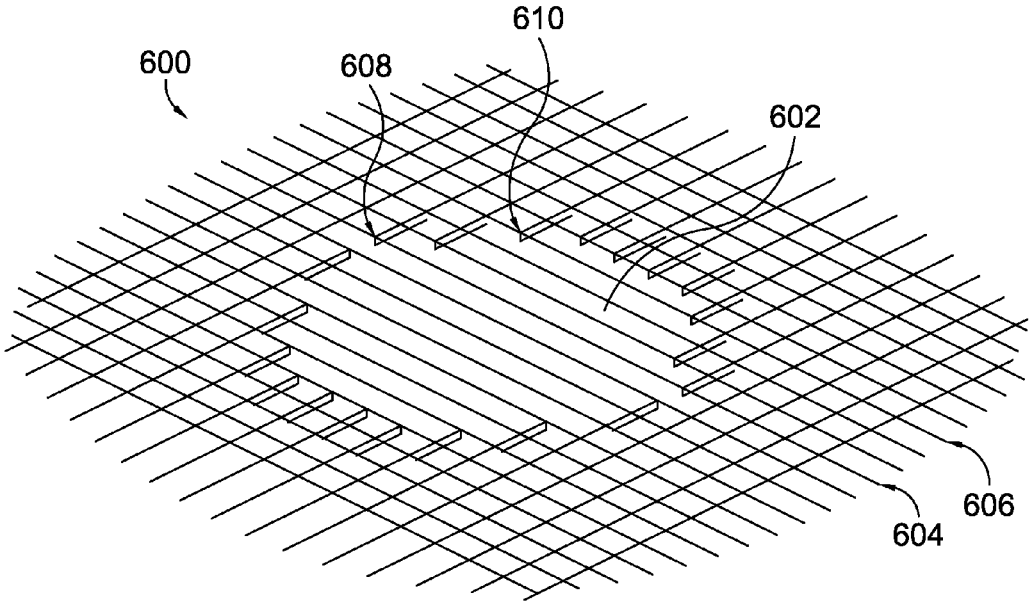

FIG. 6 depicts a portion of a woven article 600 comprised of an internal aperture 602, in accordance with aspects of the present invention. The article 600 is formed with a plurality of warps, such as warps 604 and 606. The article 600 is also formed with a plurality of wefts, such as wefts 608 and 610. The aperture 602 is formed having a gradient perimeter (e.g., semi-circular in appearance). This gradient perimeter may be accomplished by adjusting which of a plurality of warps onto which a weft extends. For example, the weft 608 extends farther than the weft 610, forming a graduated perimeter of the aperture 602. In this example, the warps continue to extend through the aperture 602; however, it is contemplated that the warps extending into the aperture 602 may be removed by one or more finishing techniques discussed herein. The warp removal may occur at any point after a subsequent weft is interwoven with the to-be-finished warp, in an exemplary aspect.

Figure 7:
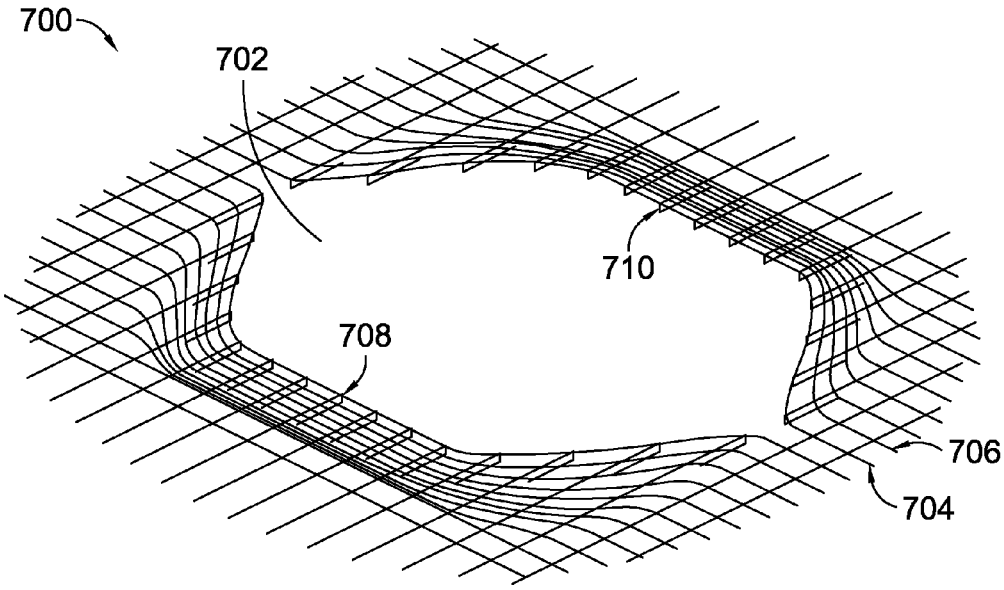

FIG. 7 depicts a portion of a woven article 700 comprised of an internal aperture 702, in accordance with aspects of the present invention. The internal aperture 702 is formed, in this example, through the pulling of the warp threads that would otherwise transverse the aperture to a side of the aperture. The pulling of the warp threads may be accomplished using a lateral-moving heddle, a warp separator (discussed hereinabove), and/or a weft tensioning process. The weft tensioning process may exert a lateral force that draws or pulls one or more warps away from an aperture to be formed. This force may be exerted as the weft is being finished to prevent an excess material accumulation. Further, it is contemplated that the weft may be pulled from a lateral edge after the finishing process is applied (and potentially prior to packing by a comb). Other exemplary aspects are contemplated.

The moveable warp concept is exemplified in FIG. 7 having a plurality of warps, such as warps 704 and 706. The warps are interwoven with a plurality of wefts, such as weft 708 and 710. The weft 708 is finished on a left side of the aperture 702 and the weft 710 is finished on the right side of the aperture 702 proximate the warp 704. The wefts maintain the warps that would otherwise traverse the aperture 702 in an offset location allowing for the formation of the aperture 702 with minimal finishing of the warps. In this example, the warps may not need a finishing process done, which may aid in maintaining the continuity of the warps through the length of the woven article 700.

Figure 8:
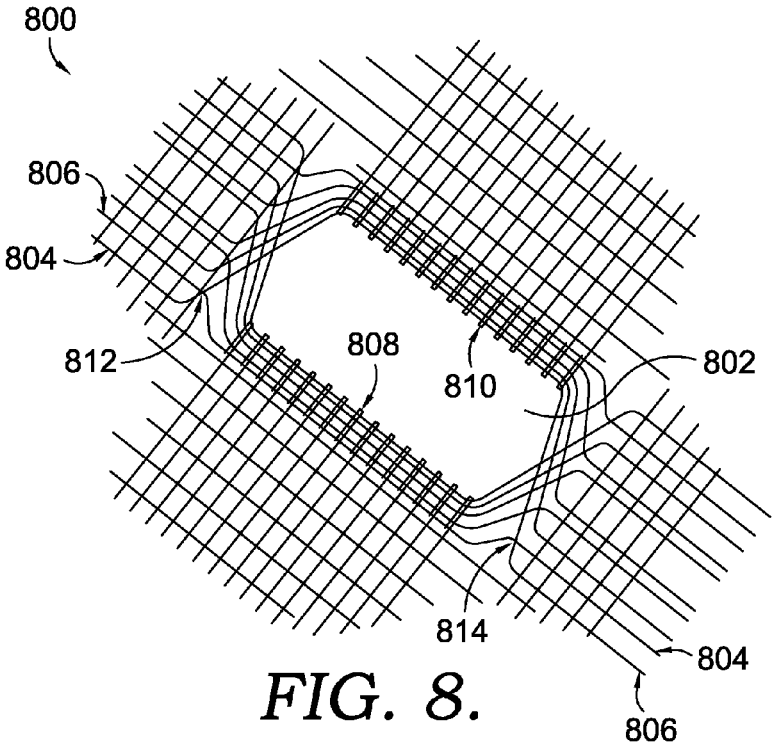

FIG. 8 depicts a portion of a woven article 800 comprised of an internal aperture 802, in accordance with aspects of the present invention. The aperture 802, in this example, is contemplated as being formed using a series of leno twist-like operations on one or more of the warp that would otherwise traverse the aperture 802. For example, a warp 804 and a warp 806 are initially twisted at a location 812 prior to diverging to opposite sides of the aperture 802. The warps 804 and 806 are then again twisted at a location 814 at a distant end of the aperture 802. The twisted warps are maintained in a separated position with one or more finished wefts, such as wefts 808 and 810. It is contemplated that any number of twists may be implemented prior to or following the aperture 802.

Figure 9:
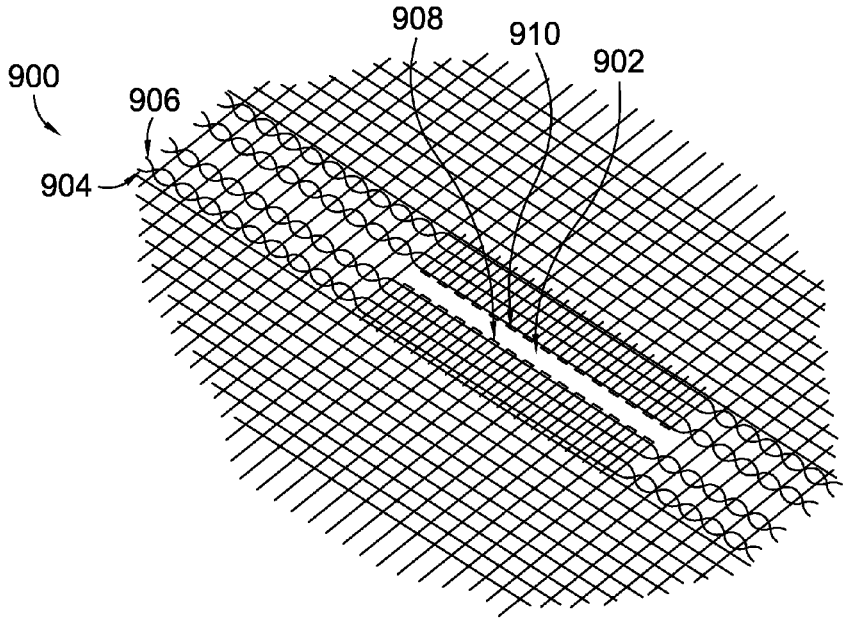

FIG. 9 depicts a portion of a woven article 900 comprised of an internal aperture 902, in accordance with aspects of the present invention. The internal aperture 902, in this example, is formed having one or more twisted pairs of warps forming the lateral perimeter of the aperture 902. For example, it is contemplated that a leno warp twist process is applied to a warp 904 and a warp 906. While the twisting is not illustrated as continuing along the perimeter of the aperture 902, other aspects may implement a twist in conjunction with one or more wefts finished to form the aperture 902. Further, it is contemplated that a twist process may begin at any point during the weaving process and is not required, in an exemplary aspect, to continue along the length of the woven article. Stated differently, a twist of two or more warps may commence at any weft and may terminate at any weft. A first side of the aperture is formed with a termination of a weft 908 and a second side of the aperture is formed with the termination of the weft 910.

Figure 10:
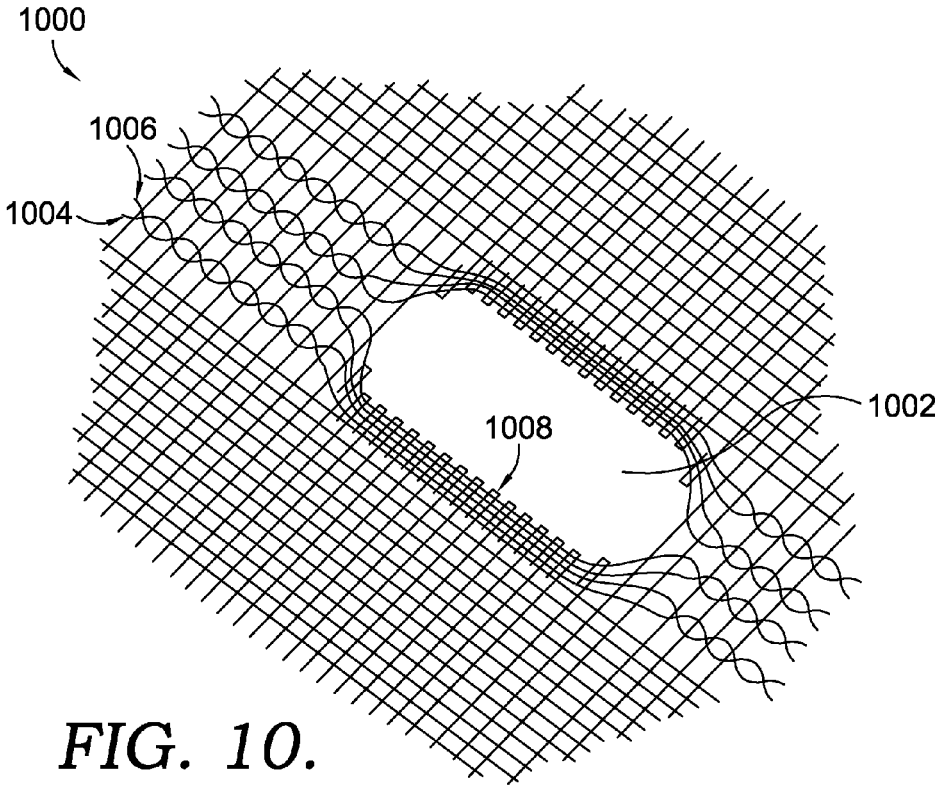

FIG. 10 depicts a portion of a woven article 1000 comprised of an internal aperture 1002, in accordance with aspects of the present invention. The aperture 1002 may be formed in manner similarly discussed with respect to FIG. 9. However, unlike that which is depicted in FIG. 9, the aperture 1002 is formed with a separating of two or more twisted warps, which may then be maintained in a separated position with one or more wefts, such as a weft 1008. As discussed with respect to FIG. 7, it is contemplated that a number of mechanisms may be implemented for moving the warp threads from their aligned position to an offset position. For example, it is contemplated that a warp separator, a laterally moveable heddle, and/or a weft tension force may be implemented to move the one or more warp to an offset position, which creates, at least in part, the aperture 1002.

It is contemplated that an aperture may have any shaped perimeter. For example, multiple curves having varied radii in various directions (e.g., different sized concave and convex-oriented curves) may be formed as a portion of the perimeter. Further, an aperture may be formed using any combination of techniques discussed herein. For example, a leno warp twist may be used to form one portion of the perimeter and an alternative technique may be used to form another portion of the perimeter, in an exemplary aspect.

Figure 11:
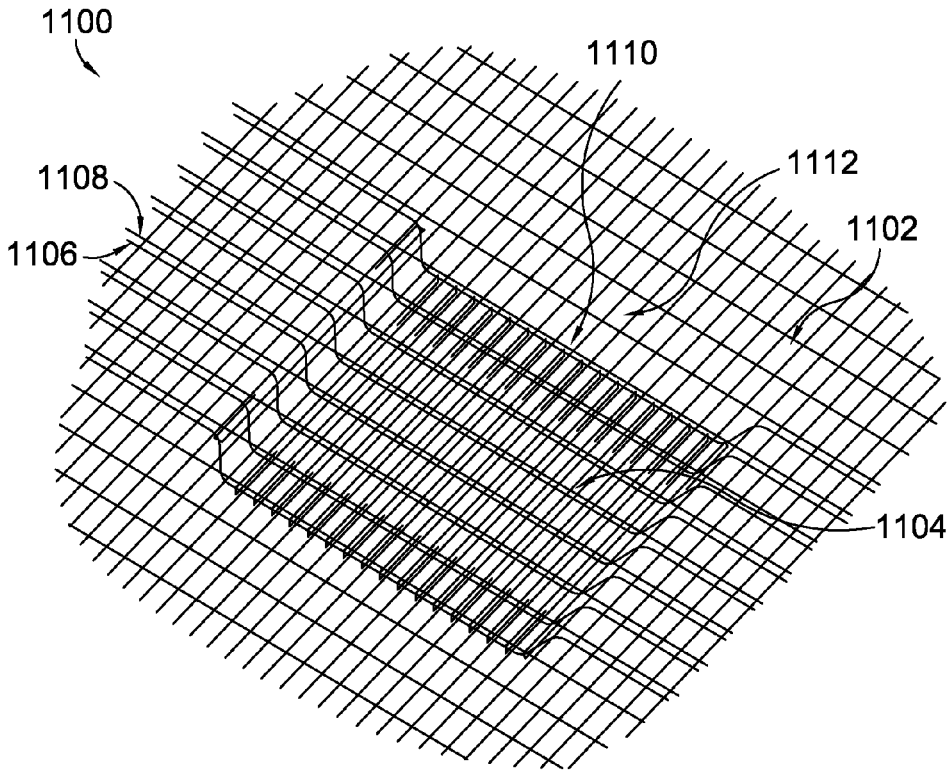

FIG. 11 depicts a portion of a woven article 1100 comprised of two layers 1102 and 1104, in accordance with aspects of the present invention. The first layer 1102 may extend in a substantially planar manner while the second layer 1104 may deviate from the first layer 1102 to form a channel or pocket. For example, it is contemplated that a first warp 1108 form a portion of the first layer 1102. And a second warp 1106 is pulled down to form a portion of the second layer 1104. This two-layer approach may allow for a channel through which a material may pass (e.g., webbing, thread, yarn, clips, and the like). Similarly, it is contemplated that the wefts may extend from the first layer to the second layer at one end of the channel to form a pocket-like enclosure. The open end of the pocket-like enclosure may be finished in one or more techniques provided herein.

As depicted in FIG. 11, a weft 1112 is interwoven with one or more warps forming the first layer 1102. A weft 1110 is interwoven with one or more warps forming the second layer 1104. While the weft 112 may be woven in a traditional manner, it is contemplated that the weft 1110 may be finished at one or both ends to form a pocket or channel respectively.

As previously discussed, a Jacquard-type machine may be implemented to raise and lower the appropriate warps at the appropriate time to form the first and the second layer. Other techniques are contemplated for forming the multi-layered woven article.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A weaving apparatus, the weaving apparatus comprising:

a first warp beam having a first number of warp tensioners adapted to maintain warp threads in tension; and a second warp beam having a second number of warp tensioners adapted to maintain warp threads in tension, wherein the first number of warp tensioners is greater than the second number of warp tensioners whereit the first number of warp tensioners on the first warp beam are adapted to maintain smaller denier warp threads in tension, and wherein the second number of warp tensioners on the second warp beam are adapted to maintain larger denier warp threads in tension.

2. The weaving apparatus of claim 1 further comprising individually positionable heddles.

3. The weaving apparatus of claim 2, wherein the individually positionable heddles are a Jacquard apparatus.

4. The weaving apparatus of claim 1 further comprising a beater adapted to two or more warp thread sizes.

5. The weaving apparatus of claim 4 wherein the beater is comprised of two or more dent sizes.

6. The weaving apparatus of claim 1 further comprising a logic unit.

7. The weaving apparatus of claim 1 further comprising a weft loader, the weft loader functional to load a first weft material in connection with the warp threads maintained on the first warp beam and a second weft material in connection with the warp threads maintained on the second warp beam.

8. The weaving apparatus of claim 1, wherein one or more warp threads maintained on the first warp beam are interwoven with a weft thread that is also interwoven with one or more warp threads maintained on the second warp beam.

9. A weaving apparatus for multiple panel weaving, the weaving apparatus comprising:

a first warp beam having a first number of warp tensioners adapted to maintain warp threads in tension;

a second warp beam having a second number of warp tensioners adapted to maintain warp threads in tension, wherein the first number of warp tensioners is greater than the second number of warp tensioners, and wherein each warp tensioner on the first warp beam is adapted to maintain a small denier warp thread, and wherein each warp tensioner on the second warp beam is adapted to maintain a large denier warp thread;

a beater adapted to simultaneously engage with the warp threads maintained on the first warp beam and the warp threads maintained on the second warp beam;

a logic unit; and a weft loader functional to load a first weft material in connection with the warp threads maintained on the first warp beam and a second weft material in connection with the warp threads maintained on the second warp beam.

* * * * *